United States Patent [19]

Black et al.

[11] 4,044,528

[45] Aug. 30, 1977

[54] METHOD AND APPARATUS FOR FORMING SEALED PACKAGES

[75] Inventors: James Harold Black, Quinton; Vernon C. Stant, Richmond, both of Va.

[73] Assignee: American Brands, Inc., New York, N.Y.

[21] Appl. No.: 502,791

[22] Filed: Sept. 3, 1974

[51] Int. Cl.[2] ..... B65B 5/02

[52] U.S. Cl. ..... 53/192; 53/234; 53/373; 93/12 C; 93/44.1 R

[58] Field of Search ..... 53/229, 234, 373, 192; 93/12 C, 12 R, 44.1 R, 44.1 GT, 36.8; 156/583; 198/24, 107

[56] References Cited

U.S. PATENT DOCUMENTS

| | | | |
|---|---|---|---|
| 2,179,685 | 11/1939 | Chalmers | 53/234 |
| 2,196,666 | 4/1940 | Moore | 93/12 R X |
| 2,603,047 | 7/1952 | Malhiot | 93/12 R |
| 2,603,925 | 7/1952 | Moore | 53/234 X |
| 2,966,832 | 1/1961 | Vergobol | 93/12 R |
| 3,041,941 | 7/1962 | Danielzig | 93/12 R |
| 3,089,298 | 5/1963 | Neuendorf | 53/373 X |
| 3,136,104 | 6/1964 | Geer et al. | 53/234 |
| 3,200,555 | 8/1965 | Liedtke | 53/231 |
| 3,220,161 | 11/1965 | Lohse | 53/373 |
| 3,407,916 | 10/1968 | Engeler | 198/24 |
| 3,802,325 | 4/1970 | Bardenhagen | 93/12 C |
| 3,805,477 | 4/1974 | Kruse | 53/236 X |

*Primary Examiner*—Othell M. Simpson
*Assistant Examiner*—John Sipos
*Attorney, Agent, or Firm*—Pennie & Edmonds

[57] ABSTRACT

A method and apparatus adapted for automatically and continuously forming a completely sealed package having fin type seals and made from a heat-sealable wrapping foil. The process basically embodies the steps of holding a portion of the foil adjacent the article to be packaged, folding the remaining portion of the foil about the article to be packaged so that opposing side edges of the foil are moved towards each other, heat sealing together the opposed side edges of the foil to form a side fin seal, forming a bottom fin from the foil for the package, heat sealing the bottom fin to form a bottom fin seal, forming a top fin from the foil for the package, and heat sealing the top fin to form a top fin seal.

27 Claims, 31 Drawing Figures

METHOD AND APPARATUS FOR FORMING SEALED PACKAGES

BACKGROUND OF THE INVENTION

1. Field of the Invention

The present invention pertains to a method and an apparatus for the making of packages or analogous containers for the reception of material. More particularly, it pertains to a method and apparatus for automatically and continuously forming completely sealed packages with fin type seals for material, such as cigarettes, cigars, pipe tobacco, or the like.

2. Description of the Prior Art

In the tobacco industry, it is a conventional practice to sell and store groups of cigarettes or the like in packages. Each grouping of cigarettes normally consists of twenty cigarettes in the customary array, namely, two outer layers of seven with a median layer containing six. Typical prior art packages for such a grouping of cigarettes are basically constituted by several components, for example, an envelope of paper backed aluminum foil, a wrapped envelope of paper, plastic, or cardboard label, and an overwrap of cellophane material or the like, with the conventional tear strip.

Generally described, heretofore known automatic wrapping machines for forming and filling such prior art cigarette packages basically perform the steps of converting blanks of material, such as a paper backed aluminum foil and paper label into an empty package, filling the package with the aforementioned cigarette grouping, and then closing the filled packages. Specifically, these types of machines feed a paper backed aluminum foil to a rotatably indexed turret which carries a plurality of discrete and circumferentially spaced forming arbors or mandrels. The fed paper backed aluminum foil is wrapped about the mandrel in such a manner that it is folded and tucked to conform to the shape of the mandrel and then is glue sealed along the side and bottom. Thereafter, a paper label is appropriately wrapped over the folded aluminum foil. After the package has been thusly formed, the grouping of 20 cigarettes are inserted into the open top end thereof. Subsequently, the top is folded, tucked, and then held in place by a glued strip of paper across the folded top of the pack.

Such prior art packages as used in the tobacco industry as well as the apparatus and method for forming the same, however, are not adapted to provide for a completely hermetically sealed enclosure. As a consequence, such packages, for example, do not adequately retain the moisture of the tobacco. Accordingly, cigarettes, for instance, would have a tendency to lose their freshness. Moreover, in certain environments, the cigarettes, whenever stored in such packages, are also subject to the possibility of insect infestation. As can, therefore, be readily appreciated, conventionally wrapped cigarette packages are not as effective in completely sealing the cigarettes as they could otherwise be.

SUMMARY OF THE INVENTION

Accordingly, therefore, the present invention is directed to overcoming the aforenoted disadvantages associated with customary cigarette packages by providing for a novel and improved method and apparatus which enables the formation of a completely hermetically sealed package for cigarettes or the like, in an automatic, continuous, reliable, and relatively economical manner.

Hereinafter essentially described, the present invention provides a continuous process adapted for use in the formation of hermetically sealed packages having fin type seals for cigarettes or the like, which packages are made from heat-sealable wrapping material. Such process comprises the steps of: advancing a sheet of wrapping material having a predetermined length to a first operating position; clamping a portion of the sheet to a mandrel; folding an opposite portion of the sheet about the mandrel such that opposing side edges of the material are moved into close proximity with each other as the mandrel is advanced from the first operating position to a second operating position; heat sealing the opposed side edges together at the second position to form a hermetic side fin seal; advancing the mandrel to a third operating position; forming a bottom fin from the wrapping material for the package; heat sealing the formed bottom fin at the third operating position to thereby provide a hermetic bottom fin seal; folding the bottom fin seal as the mandrel is advanced to a fourth operating position; filling the partially formed package with a grouping of cigarettes at a filling position; forming a top fin from the wrapping material at the top of the package; and heat sealing the top fin to form a hermetic top fin seal. The invention also comprises the novel apparatus hereinafter described and claimed.

BRIEF DESCRIPTION OF THE DRAWINGS

These and other objects, features and advantages of the present invention will become apparent after a reading of a description of the invention which is made in accordance with the principles thereof when viewing the accompanying drawings wherein like reference numerals indicate like structure throughout the several views.

DESCRIPTION OF A PREFERRED EMBODIMENT

Figure 1:
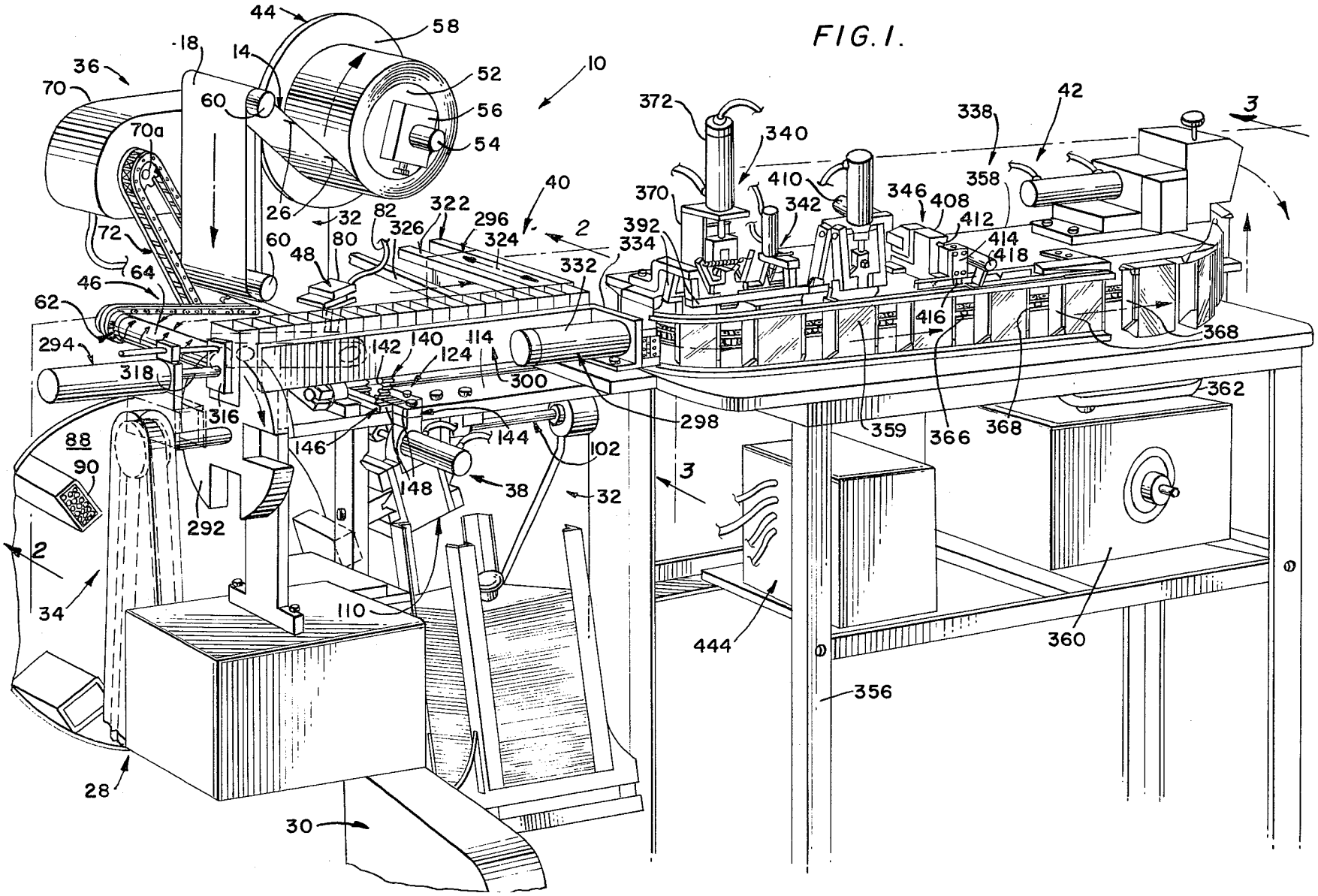
FIG. 1 is a perspective view of the automatic wrapping machine embodying the principles of the present invention.

Referring now to FIG. 1 of the drawing, there is disclosed an improved automatic wrapping machine made in accordance with the principles of the present invention and generally designated by reference number 10. The preferred embodiment of the automatic wrapping machine 10 to be subsequently described enables a continuous process to be performed which is particularly adapted for use in the formation, filling, and sealing, preferably hermetic sealing, of an improved type of cigarette package or pouch 12, such as best depicted in FIGS. 26 to 30. This particular package 12 is formed from a single sheet of foil wrapping material 14 which includes a main body portion 16 having an inner sealing surface 18, top 20, bottom 22, and side 24 fin type seals (FIGS. 1 and 26 to 30). Also formed on the wrapping material 14 at predetermined longitudinal intervals, are sensing lines 26 which enable the wrapping material to be cut into predetermined lengths as subsequently described. In addition, such wrapping material 14, contemplated for use in connection with the automatic wrapping machine 10, preferably may be made from any appropriate relatively thin, flexible, and sheet-like laminate material which possesses suitable heat-sealable characteristics for purposes afterwards made apparent.

It should be pointed out, however, that many details of the improved automatic wrapping machine 10 are of the same gneral structure as of basic type of cigarette wrapping machines which are disclosed in the following U.S. Pat. Nos.:

1,682,464
1,765,820
1,847,060
1,885,893
1,885,910
1,926,192
1,998,067
2,259,445
2,344,666
2,344,667
2,378,457
2,402,231

Accordingly, only those aspects and parts of this basic machine necessary for a complete understanding of this particular invention will be herein referred to, as all other relevant details of the automatic wrapping machine are fully disclosed in the above referenced patents. Although the succeeding description of the invention will be directed to the formation of hermetically sealed packages and pouches 12 for cigarettes, it is well within the spirit and scope of the present invention that other articles and commodities, such as, for example, rod-like tobacco objects, including cigars, cigarillos, and cheroots, may be equally as effectively wrapped and sealed; preferably hermetically sealed.

Hereinafter, essentially, described the novel and improved automatic wrapping machine 10 of the present invention comprises a conventional machine support assembly means generally indicated by reference number 28, including machine base 30, machine framework 32, and indexing turret means 34, foil supply and cutting assembly means 36, foil folding and sealing assembly means 38, transfer assembly means 40, and top fin forming and sealing assembly means 42.

Figure 2:
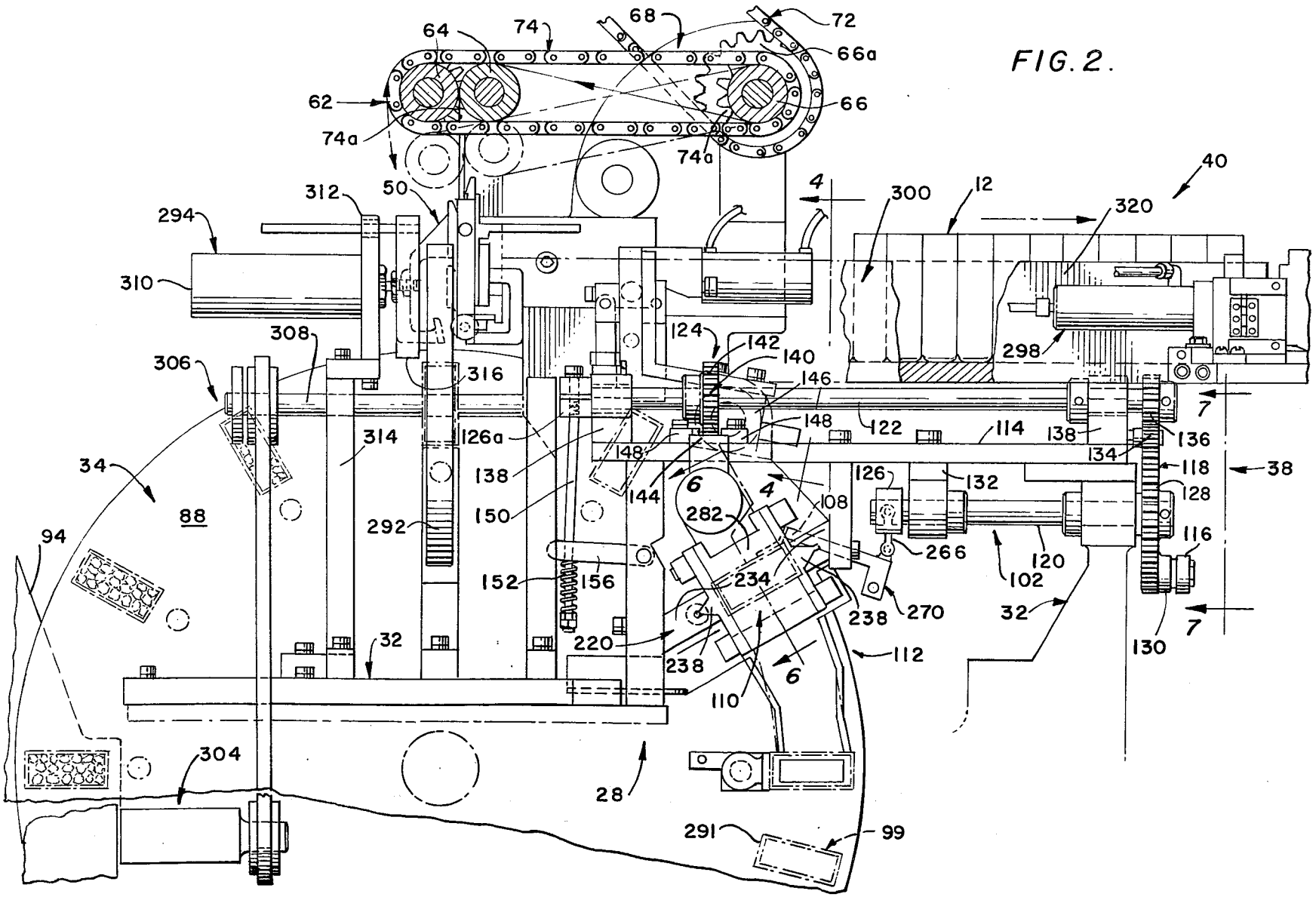
FIG. 2 is a view taken substantially along the section line 2—2 in FIG. 1 looking in the direction of the arrows and illustrating greater detail of portions of the automatic wrapping machine.

With reference to FIG. 1 taken in conjunction with FIG. 2, the foil supply and cutting assembly means 36 is best depicted as basically including foil supply means 44, foil feed advance means 46, detection means 48, and foil cutting means 50.

As perhaps best shown in FIG. 1, the foil supply means may include a foil reel 52, a stationary spindle 54, end clamp unit 56, and mounting plate 58. The foil reel 52 has wrapped thereabouts a supply of the noted wrapping material 14 which is to form the package or pouch 12 for cigarettes or the like. As previously mentioned, the wrapping material 14 which is contemplated for use in wrapping cigarette packages 12 should possess heat-sealable properties. One such heat-sealable material which has been successfully employed to form the novel and improved hermetically sealed package 12 is a lamination comprising an outer layer of cellophane, intermediate layers of polyethylene and aluminum foil, and the inner surface 18 being made of polyethylene. It should be pointed out that the outer layer of cellophane can also be reverse printed so that it can also perform a design function. It will be evident that any heat-sealable material in addition to polyethylene can be suitably used. As will be more fully described the inner polyethylene surface 18 is brought together to serve as the heat-sealing surface, whereby the noted top 20, bottom 22, and side 24 fin seals of the package 12 are formed. The thickness of the inner surface 18 should be of a sufficient magnitude to produce a polyethylene to polyethylene fin seal whenever heated and brought together. By such an arrangement, a container or pouch 12, such as a cigarette package, is capable of being formed with an effective hermetic seal which facilitates improved retention of moisture and freshness. The above noted foil reel 52 with material 14 wrapped thereabouts is appropriately rotatably mounted on the stationary spindle 54 which spindle extends outwardly from and is connected to the mounting plate 58. The end clamp unit 56 is of a known type and generally serves to detachably and firmly mount the foil reel 52 on the stationary spindle.

With continued reference to FIGS. 1 and 2, there is illustrated the foil feed advance means 46. Such foil feed advance means 46 basically includes a pair of tension rolls 60, pivotal foil feed carriage 62, a pair of cooperating foil advance rollers 64, foil advance roller 66, sprocket and chain drive arrangement 68, and clutch and brake drive unit 70. The pair of tension rolls 60 are connected to the machine framework 32 adjacent foil reel 52 and have the wrapping material 14 passed therearound in a manner, such as indicated in FIG. 1. Tension rolls 60 primarily function to tension the wrapping material 14 as it is advanced to and by pivotal foil feed carriage 62. Foil feed carriage 62 is operatively connected to the automatic wrapping machine 10 in a suitable manner (not shown) so as to be movable in an up and down fashion. As a consequence of such motion, the rate of wrapping material 14 feed is increased. Connected at the forward end of the foil feed carriage 62 and journalled for rotation with respect thereto is the pair of cooperating foil advance rollers 64, and also journalled for rotation with respect thereto at the opposite end thereof is the other foil feed advance roller 66. The sprocket and chain arrangement 68 includes a first sprocket and chain assembly 72 which suitably drivingly interconnects the clutch and brake drive unit 70 with the foil advance roller 66 through suitably connected chain sprockets 70*a* and 66*a*, so that the former may drive the latter. A second sprocket and chain assembly 74, a portion of which is shown in FIG. 2, is suitably connected to and driven by the first chain assembly 72 for rotatably driving the pair of cooperating foil advance rollers 64 conjointly with foil advance roller 66 through chain sprockets 74*a*.

In the present embodiment, the foil feed advance rollers 64 and 66 are selectively and intermittently driven by the clutch and brake unit device 70. This clutch and brake unit 70 is of the type which is actuatable to either transmit motion from a drive motor (not shown) or stop the transmission of motion in response to appropriate operating signals. By reason of the above noted constructional arrangement, the foil feed advance rollers 64 and 66 may be either drivingly rotated or stopped for purposes presently made clear. In the preferred embodiment, whenever the sheet-like wrapping material 14 is advanced by the foil feed advance rollers 64 and 66 it is done so in the manner indicated in FIGS. 1 and 2.

Figure 8:
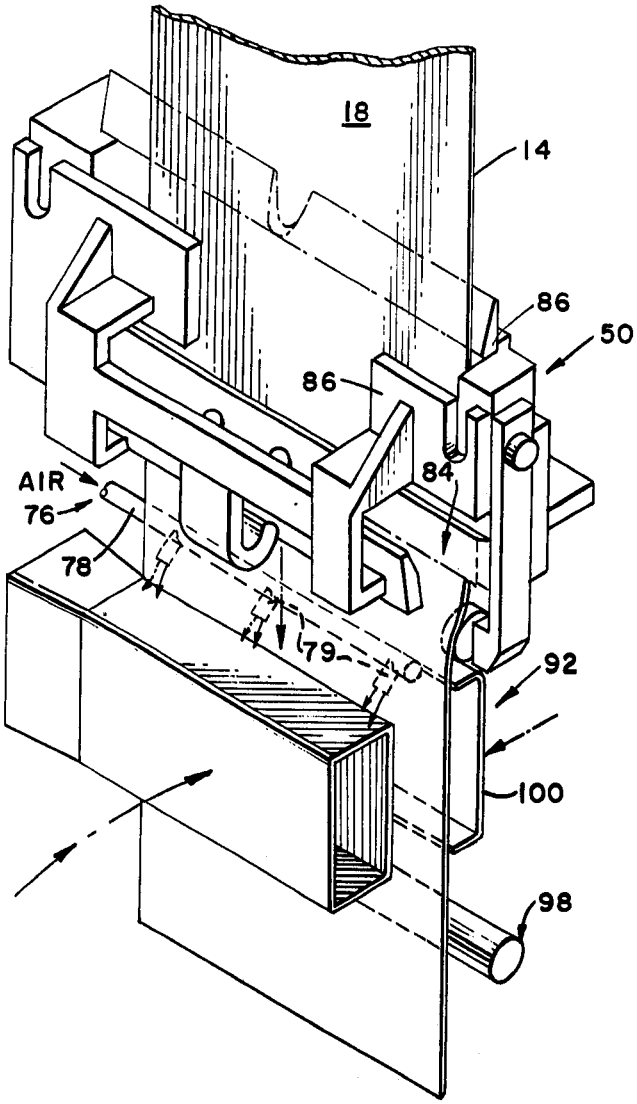
FIG. 8 is an enlarged perspective view illustrating the foil cutting assembly of the present invention.

As shown in FIG. 8, the foil feed advance means 46 may also include a first air assist means 76 which may be defined by a tube 78 of appropriate material. The tube 78 is suitably connected to the machine framework 32 and to a source of pressurized air (not shown). Tube 78 with nozzles 79 is situated so as to direct the pressurized air onto the wrapping material 14 for further assisting the advancement thereof into cooperation with the indexing turret means 34.

The detection means 48 is suitably affixed to the pivotal carriage 62 and is effective to sense whenever an appropriate length of wrapping material 14 has been advanced for forming an individual package. Detection means 48 as used in the instant embodiment, may be any type of electric photocell 80 which has a pair of leads 82 extending therefrom for electrically operatively connecting it to the clutch and brake unit 70. Whenever the detection means 48 senses the appropriate passage of the sensing lines 26, thereby indicating that the desired length of foil wrapping material 14 has been advanced, it transmits an appropriate electrical signal to the clutch and brake drive unit 70 for actuating the latter so as to stop its operation. Thereby rotation of the foil feed advance rollers 64 and 66 and advancement of wrapping material 14 is correspondingly halted. From the foil feed advance means 46, as aforedescribed, the wrapping material 14 is advanced in a generally downward direction to the foil cutting means 50.

Particularly referring to FIGS. 2 and 8, the foil cutting means 50 of the present embodiment is essentially a well-known conventional type, and therefore, only those parts necessary for an understanding of its operation in this invention will be presently described. Such foil cutting means is suitably connected to the machine 10. The only basic change made to this known type of foil cutting means 50 has been to appropriately lengthen blades generally indicated by reference numeral 84 so as to accommodate the width of foil wrapping material 14 since such material 14 somewhat exceeds the normal width of the wrapping material customarily used to form packages. Such change, however is considered to be within the purview of one skilled in the art and, therefore, details as to the modifications made have not been set forth in any detail. As noted in FIG. 8, the wrapping material 14 generally vertically extends between two mounting plates 86 of the foil cutting means 50. The cutting means 50 as above disclosed appropriately severs or cuts the foil wrapping material 14 whenever the foil feed advance means 46 has stopped operation the material 14 is clamped in a manner to be presently described, and the indexing turret means 34 operated.

Figure 9:
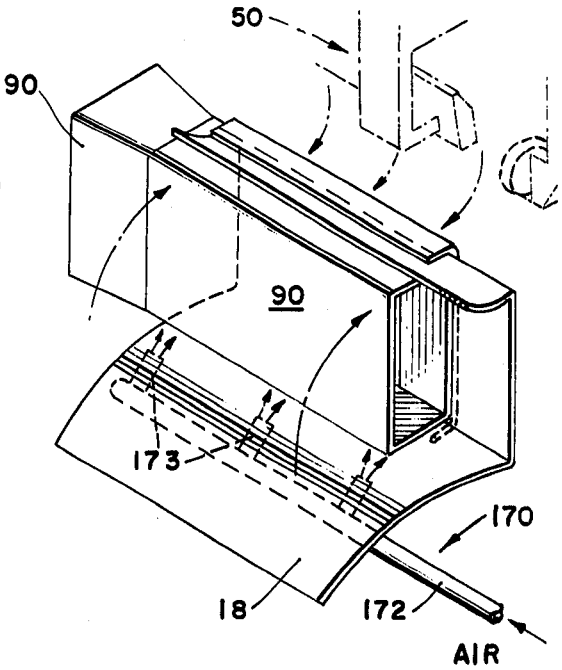
FIG. 9 is an enlarged perspective view illustrating the wrapping material being folded about a mandrel.
Figure 18:
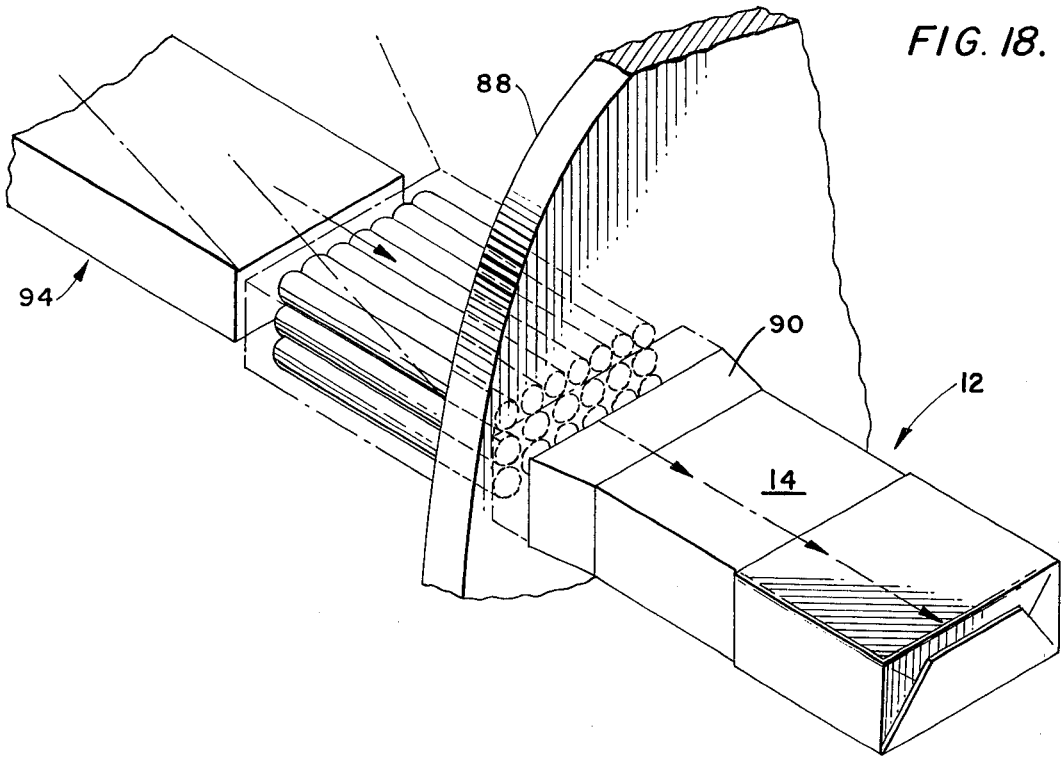
FIG. 18 is an enlarged fragmented perspective view illustrating the cigarettes being forced into a mandrel at a package cigarette filling station.

Again referring to both FIGS. 1, 2, and to FIGS. 8, 9 and 18 there is depicted in somewhat greater detail the indexing turret means 34. Such indexing turret means envisioned for use in the instant invention is also well known in its construction and operation and, hence, only that structure necessary for a complete understanding of the preferred embodiment will be subsequently set forth. As denoted, the rotatable index turret means 34 includes at least a rotatable indexing turret wheel 88, a plurality of hollow mandrels or forming arbors 90, arbor clamping units 92, cigarette pushing means 94, package ejectment mechanism 96, center post 98 and bottom fin ear folding station 99. The forming mandrels 90 are suitably affixed to the indexing turret wheel 88 in such a manner that they are circumferentially spaced with respect to each other. The indexing wheel 88 is of conventional design and is operated in a known fashion by suitable means not shown but nonetheless well known. Each of the mandrels 90 is intermittently and successively rotatably advanced in a step-by-step manner from a first operating position to at least second, third, fourth, and fifth operating positions for the forming and sealing operations which will be subsequently set forth in the succeeding description of the present invention. Although six operating positions are to be presently described, it should, of course, be pointed out that the respective mandrels 90 of the indexing turret wheel 88 will be normally be indexed through twelve individual positions, whereat other conventional operations such as, for example, label applying and folding, and cigarette end testing are performed. For the sake of convenience, however, in describing the operations of the present invention, it will be understood that the first operating position is located at what would normally be referred to as the twelve o'clock position, and the consecutively arranged second, third, and fourth operating positions would appropriately correspond to the one, two, and three o'clock positions, respectively. As best shown in FIG. 2, the foil cutting means 50 is situated vertically above the first operating position. In this particular arrangement, the foil wrapping material 14 descends past the cutting blades 84 and adjacent the forming mandrel 90. A clamping plate 100 of the arbor clamping unit 92 is operated in a known fashion, while the index turret wheel 88 is stopped at the first position for clamping a portion of the foil wrapping material 14 tightly against one side of the mandrel 90 as shown more clearly in FIGS. 8 and 9. The mandrel 90 with the foil wrapping material 14 clamped thereto is advanced to the other operating positions for subsequent forming operations performed by the foil folding and sealing assembly to be hereinafter described.

Hereinafter, essentially, described the foil folding and sealing assembly means includes foil folder and seal drive means 102, a side foil folder means 104, side sealing means 106, a fin folder means 108, a bottom fin forming and sealing means 110, and bottom fin folding means 112.

As perhaps best illustrated in FIG. 1, taken in combination with FIG. 2, the folder and sealing drive means 102 basically includes a mounting bracket plate 114, an oscillatable motion producing means or driving lever 116 which is appropriately connected to and driven by a suitable cam (not shown) on the automatic wrapping machine 10, a common transmission drive means or gear train 118, a pair of first and second oscillatable drive shafts 120, 122, respectively, a motion converting means 124 and drive collars **126, 126*a*.**

Figure 7:
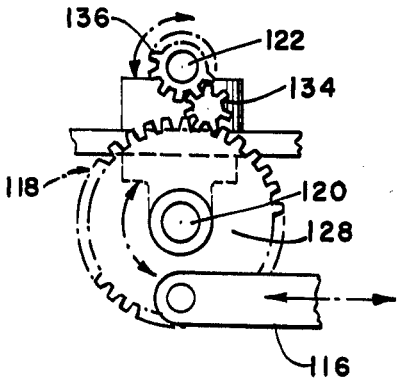
FIG. 7 is an end elevational view taken substantially along line 7—7 in FIG. 2 and illustrating other details of the present invention.
Figure 11:
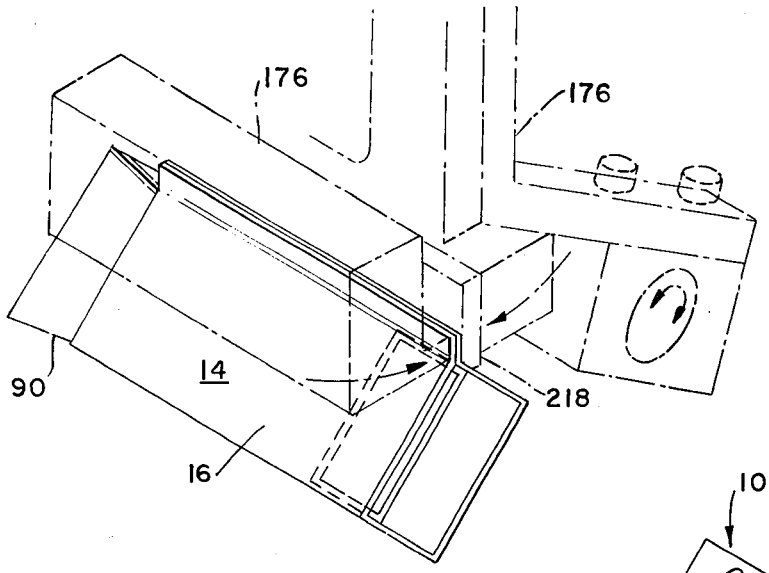
FIG. 11 is a perspective view illustrating the heat sealing operation which is performed on the side seal of the package.

Although oscillating driving lever 116 is connected to a suitable cam on the automatic machine 10 for purposes of producing oscillating movement, other equivalent motion producing mechanisms may be employed so long as they produce such oscillatory movement. In addition, the oscillations of the oscillating drive lever 116 are timed with the movement of the rotatable indexing wheel 88 so that the operations performed by the folding and sealing assembly means 38 appropriately correspond to the movement of the indexing wheel for reasons hereinafter made apparent. The oscillating lever 116 as shown in FIGS. 2 and 7 is connected to a drive gear 128 of the gear train 118 through a bushing 130. Bushing 130 serves to provide a better support for the oscillating driving lever 116 so as to avoid possible failure of the connection with drive gear 128. Connected to the drive gear 128 is the first oscillatable driving shaft 120 which is suitable journalled in the machine framework 32 and a bearing block 132 (FIG. 2) connected to the mounting bracket plate 114 for corresponding oscillation in response to oscillation of the drive gear 128. Such first drive shaft 120 has fixedly connected at one end thereof drive collar 126 for actuating fin folder means 108 (FIG. 12) in a manner to be described. An idler gear 134 (FIG. 7) externally meshes with the drive gear 128 and serves to similarly and simultaneously oscillate an externally toothed spur gear 136 which is connected to the second oscillatory drive shaft 122. Oscillation of the spur gear 136 will, therefore, result in a corresponding oscillation of the second oscillatory drive shaft 122. Such second oscillatory drive shaft 122 is appropriately journalled for oscillatory movement with respect to mounting bracket 114 by a bearing block 138, suitably connected to the mounting bracket plate. Detachably fastened to the end of the second oscillatory drive shaft 122 is the drive collar **126*a* for transferring oscillation to the foil folder means 104. In the preferred embodiment, the motion converting means 124 (FIGS. 1 and 2) may be defined by a rack and pinion device 140. Such rack and pinion device 140 has a pinion 142 secured to the second oscillatory drive shaft 122 for conjoint movement therewith. The rack member 144 is, in suitable fashion, longitudinally reciprocated in a rack guide arrangement 146 for cooperating with the bottom fin forming and sealing means 110 as subsequently set forth. In the present embodiment, the rack guide arrangement 146 may include a pair of guide blocks 148 suitably secured to the mounting bracket plate 114.**

Figure 10:
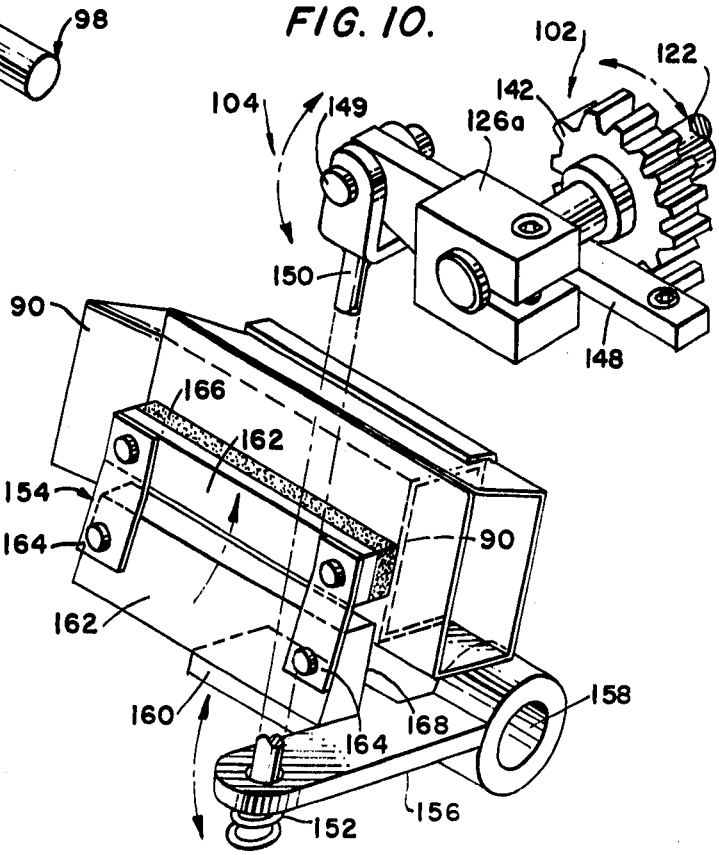
FIG. 10 is a perspective view illustrating the foil folder assembly of the present invention folding the wrapping material.

Now particularly referring to FIG. 2 taken together with FIG. 10, there is best shown the novel side foil folder means 104 of the present invention. Such foil folder means 104 is operatively mechanically connected to the folder and sealing driving means 102 in a manner to be presently set forth which will enable it to selectively pivotally move toward and away from the mandrel 90. Whenever foil folder means 104 is operated to move toward the mandrel, it will urge the depending side edge of the foil wrapping material 14 toward the clamped opposed side edge thereof. Basically described, the side foil folder means 104 (FIG. 10) includes a connecting rod means 150, a connecting rod biassing means or spring 152, foil folder unit 154, and a pivotal lever arm 156. The connecting rod may be conventionally connected to the fixed drive collar 126a on the second oscillating drive shaft 122. Accordingly, the connecting rod 150 will generally vertically reciprocate in an up and down manner in response to oscillation of second oscillating drive shaft 122. Such vertical movement is effective to pivot the pivotal lever arm 156 to which connecting rod 150 is secured in a similar up and down movement. Pivotal lever arm 156 is shown pivotally connected to a hanger or pivot shaft 158 which extends from the machine framework 32 or other suitable type support. A projection 160 integrally extends from pivotal lever arm 156 and the foil folder unit 154 is fixedly connected thereto for movement therewith.

As shown in FIG. 10, the folder unit 154 is comprised of two generally elongated and parallel folder bars 162 with the lower bar connected to projection 160. Two generally resilient strips 164 serve to interconnect the folder bars 162. These resilient strips 164 are biased such that whenever the bars 162 contact the mandrel 90 their inherent resiliency will tend to reduce the effect of the bars 162 bouncing from the mandrel 90 upon contact therewith. Consequently, the strips 164 facilitates a tighter type of wrapping or folder action of the wrapping material 14 as it is brought into engagement with the mandrel. To further enhance the wrapping action to be described afterwards, the top folding bar 162 is provided with a resilient cushion 166 made of a suitable material, such as rubber. The lower folding bar 162 is tapered as indicated by reference numeral 168 by an appropriate angle extending outwardly from top to bottom, such that whenever pivotally moved towards the mandrel 90 it will flatly press the wrapping material 14 to the side of the mandrel. In addition to the previously mentioned provisions for insuring firm engagement of the unclamped portion of the wrapping material 14 to the mandrel 90, the connecting rod biassing means or spring 152 is provided. As indicated in FIG. 2, the spring 152 is disposed between the underneath surface of the pivotal lever arm 156 and an adjustable nut threaded to the end of connecting rod 150. By such arrangement, the spring 152 is effective to further insure firm engagement of the foil wrapping material 14 against the mandrel 90 to as to compensate for possible mandrel misalignment, insure relatively constant pressure for material 14, and also prevent against the tendency of the foil folder unit 154 to bounce. As can be readily appreciated, not only will the reduction and prevention of bouncing improve the firmness of the fit against mandrel 90, but also more reliably present the polyethylene inner surface 18 of the unclamped edge portion toward the polyethylene inner surface 18 of the clamped opposed edge so that these two edges will be in close proximity to each other for the side sealing operation to be performed. At this point, mention should be made that pivotal movement of the foil folder unit 154 is arranged such that it is effective to wrap or fold the wrapping material 14 as the mandrel 90 is incrementally advanced from the first operation position to the second operation position.

During such transit of the mandrel 90 between the first and second operation positions, the unclamped portion of wrapping material 14 is to be also folded generally upwardly by the center post 98 as indicated in FIG. 8. The present invention also contemplates that the foil folder means 104 may include a second air assist means 170 (FIG. 9) which may be defined by a tube 172 having a plurality of nozzles 173. The tube 172 is suitably connected to the machine framework 32 and a source of pressurized air (not shown). This tube 172, however, differs from tube 78 in that it directs air upwardly toward the mandrel 90 during folding of material 14 by center post 98 and foil folder means 104. The second air assist means 170 serves the purpose of overcoming the tendency for the relatively thin wrapping material 14 to curl as it is being worked upon. Accordingly, this action further enables the wrapping material 14 to be more tightly folded or wrapped against the mandrel 90.

Figure 5A:
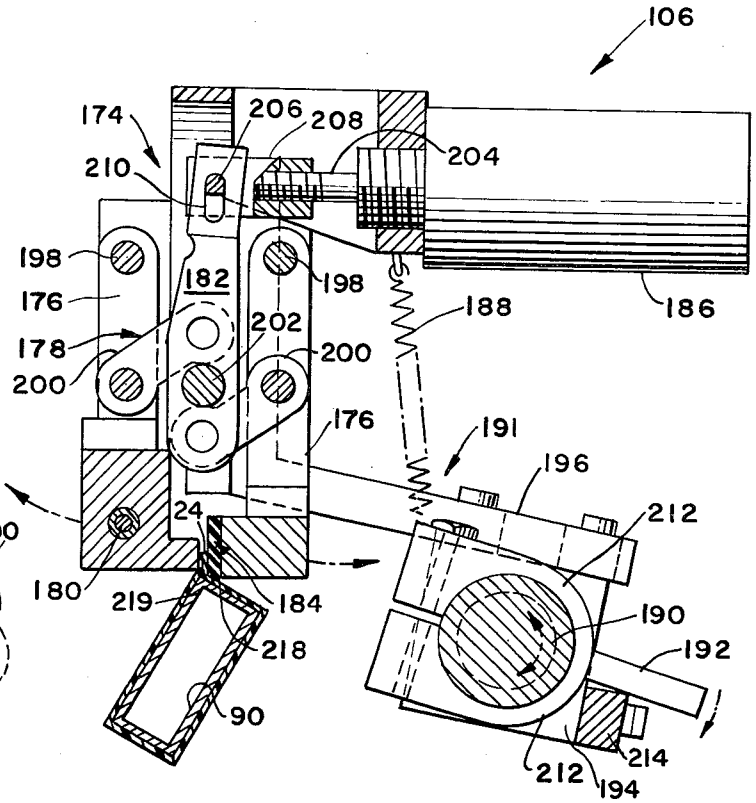
FIG. 5A is a sectional side elevational view substantially taken along the section line 5A—5A in FIG. 4 and illustrating the side fin sealing assembly in an operative position.
Figure 4:
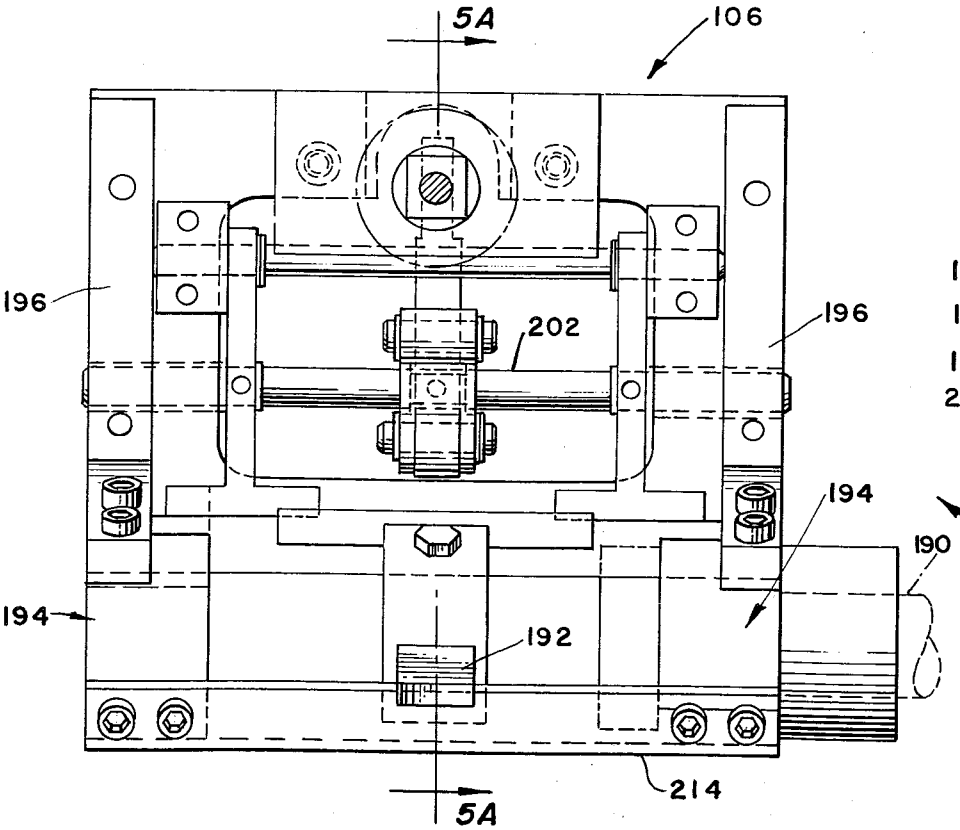
FIG. 4 is a view taken substantially along the section line 4—4 of FIG. 2 looking in the direction of the arrows and illustrating an end view of the side fin sealing assembly of the present invention.
Figure 5B:
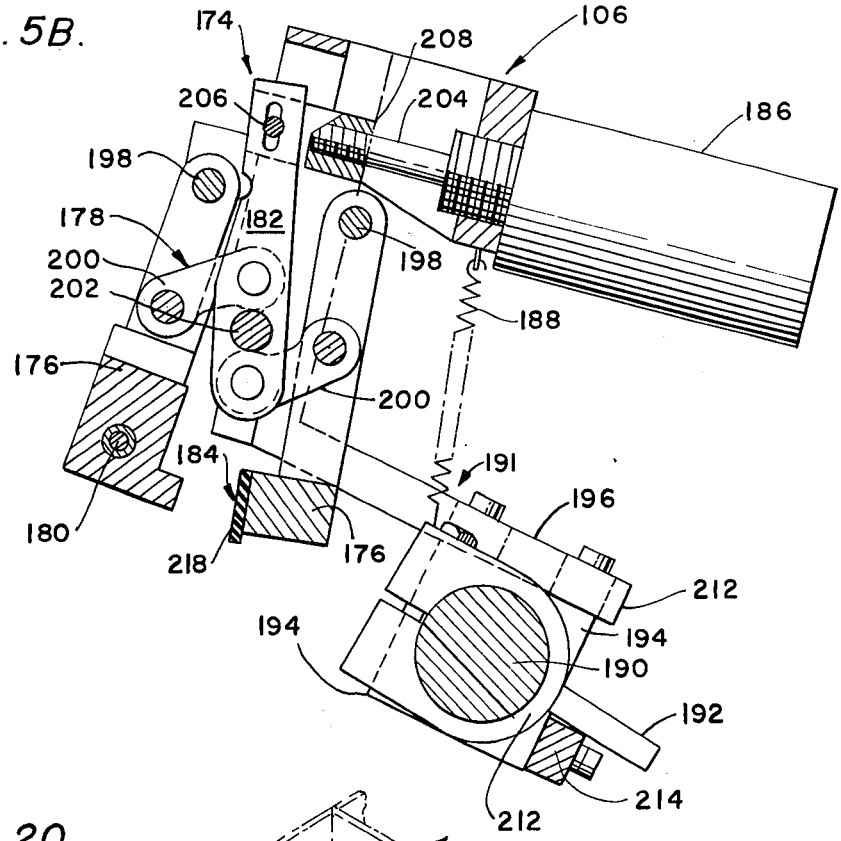
FIG. 5B is a view similar to FIG. 5A but showing the side fin sealing assembly in an inoperative position.

Now with reference to FIG. 1 taken with FIGS. 4, 5A and 5B the side fin seal means 106 is more clearly depicted. Such side fin seal means 106 functions to hermetically seal together the polyethylene heat sealable inner surface 18 of the opposed side edges of the wrapping material 14 whenever the mandrel 90 is advanced to the second operation position. The side fin sealing means 106 is normally in a raised and inoperative position as indicated in FIG. 5B. Basically defined, side fin sealing means includes a support frame generally indicated by reference number 174, a pair of spaced apart and pivotally movable jaw means 176, an appropriate type of fist parallelogram type linkage means 178, a conventional type heater cartridge 180, pivotal actuating rod means 182, friction pad means 184, selectively energizable side sealing fluid motor unit means 186, biassing spring or resilient means 188, a third oscillating drive shaft 190, and motion transmitting means 191 including a tongue 192, a pair of loosely fitted clamp means 194, and motion transmission linkage 196.

As shown in FIG. 5B, the opposed jaws 176 are pivoted to support frame 174 as at 198, and are normally spaced apart except during the actual sealing operation as depicted in FIG. 5A. First linkage means 178 includes a pair of rocker arms 200 which serve to interconnect respective ones of the jaws 176 to the pivotal actuating rod 182 in known fashion. The purposes of such interconnection enables the application of equal and opposite forces by the jaws 176 as well as equal movement thereof. Such action improves positioning of the jaws 176 during the heat sealing operation. Transversely connected to the support frame 174 is an actuating rod pivot shaft 202 which permits actuating rod 182 to pivot. Whenever the actuating rod 182 is pivoted generally clockwise from the open position for the jaws as indicated in FIG. 5B, to the closed position for the jaws as indicated in FIG. 5A, it is effective in a conventional manner, to operate the rocker arms 200 so as to bring the opposed jaws 176 together. Conversely, whenever the actuating rod 182 is pivoted generally counterclockwise from the closed position of the jaws (FIG. 5A), it forces the rocker arms 200 apart such that the jaws 176 are forced apart. While the jaws 176 are actuated, as indicated, to move inwardly and outwardly with respect to each other, they are also appropriately lowered and raised, respectively, in a manner to be presently set forth. However, to effect the noted generally pivotal movement of the actuating rod 182 the top end thereof is secured for movement with a piston rod 204 of the fluid motor unit means 186 through a pin 206 connected to a clevis 208 attached to piston rod 204. As shown, the actuating rod has a generally vertical slot 210. Such fluid motor unit means 186 may be of any suitable and generally known type which is presently commercially available. The fluid motor unit 186 is shown detachably affixed to the support frame 176 and may be appropriately energized whenever a respective one of the mandrels 90 is positioned at the second operating position.

As mentioned, the jaws 176 are movable in an up and down fashion so as to properly position the heater cartridge 180 for sealing the side fin. Generally described to vertically move the jaws 176, the transmission linkage 196 is interconnected between the support frame 174 and the third oscillating drive shaft 190. More particularly described, two clamps 194 are loosely fitted on the third oscillating drive shaft 190 and have an elongated driven bar 214 interconnected between clamps 194. The driven bar 214 is arranged to always contact drive tongue 192 which is appropriately connected to third oscillating drive shaft 190 by clamps 212. It should be pointed out that the drive tongue 192 and third oscillating shaft 190 pivotally supports the clamp means 194, jaws 176, first linkage means 178, side sealing motor means 186 and support frame 174 for enabling the noted vertical reciprocation. Consequently, whenever drive tongue 192 oscillates in the clockwise direction, as viewed in FIG. 5A, in response to oscillation of the third oscillatory drive shaft 190, the tongue 192 which contacts the driven bar 214 will act to force the clamps 194 in a similar clockwise direction. In so doing, the clamps 194 correspondingly raise the transmission linkage 196. Accordingly, since the transmission linkage 196 is connected to the support frame 174, the jaws 176 and fluid motor means 186 will also generally pivot upwardly from the position indicated in FIG. 5A to that shown in FIG. 5B. Upon oscillation of the third oscillatory drive shaft 190, in the opposite direction, the tongue 192 will move in unison, therewith. Since, as aforementioned, such components as the clamp means 194, jaws 176, first linkage means 178, fluid motor means 186 and support frame 174 are generally loosely mounted upon the third oscillatory drive shaft 190 in the manner above indicated they will, under the influence of gravity, generally pivot downwardly while remaining in non-yielding contact with the tongue 192. Consequently, the jaws 176 will move downwardly towards the mandrel 90. The downward limit of this motion is determined by the degree of oscillation of the third oscillating drive shaft 190. At the end of this downward movement the fluid motor means 186 is energized to retract piston rod 204. In such a manner, piston rod 204 will move the pivotal actuating rod 182 toward the fluid motor 186 and by reason of the first linkage means 178 operates the jaws 176 so that they are moved toward each other for effecting the heat seal operation. Mention should be made that the third oscillating drive shaft 190 is operatively connected to the automatic machine 10 to be oscillated thereby. In the preferred embodiment of this invention, such shaft 190 may be what was once the foil folder shaft in the basic machine described by the above referenced patents. Of course, the timing of the third oscillating drive shaft 190 has been, in a known manner, adjusted so as to coincide with the series of operations performed by the present invention.

The resilient means or biasing spring 188 is interconnected between the fluid motor unit means 186 and clamp means 194 so as to spring load the jaws 176 generally downwardly to thereby provide a constant downward pressure and also to properly position the jaws with respect to the mandrel 90.

As viewed in FIGS. 5A and 5B the heater cartridge 180 is perhaps best viewed. This cartridge 180 is of a known type and is suitably attached to one of the jaws 176. Such cartridge 180 is appropriately electrically heated to temperatures sufficient in magnitude to heat seal the polyethylene inner surfaces 18 together for the duration such heat cartridge 180 will contact the wrapping foil 14. Of course, such temperatures may vary in accordance with the type of heat-sealable material being used and timing required without departing from the spirit and scope of the present invention.

Attached to the jaw 176 opposite the heat cartridge 180 is friction pad means 184 preferably, made of silicon rubber or the like which is arranged to extend along the longitudinal extent of the jaw 176. It will be understood that whenever the jaws 176 are moved to the heat sealing position, indicated by FIG. 5A, a protrusion 218 of such friction pad means 184 extends below the bottom surface of the jaw 176 carrying heater cartridge 180. The particular significance of such protrusion will be shortly discussed.

The silicon rubber fricton pad 184 serves to assist in pulling on the side edge of the clamped portion of wrapping material 14 as the latter is urged towards the corner 219 of the mandrel 90 by the jaws 176 as they are in a process of being brought together. Silicon rubber has been found to be an effective material in providing sufficient friction for the foil wrapping material 14 so that the foil will not slide therefrom as it is moved towards the corner 219 of the mandrel 90. In addition, silicon rubber has adequate heat resistant characteristics which permit its use with the heater cartridge 180 without failure. Other materials, of course, which have heat resistant and friction characteristics similar to that of silicon rubber may be utilized.

In addition, the protrusion 218 of the silicon rubber friction pad 184 is provided to extend beneath the bottom surface of the opposing heater cartridge 180. By this particular arrangement, the sealing of the edge of the wrapping material 14 to the mandrel 90 is avoided. Consequently, the ejection mechanism or means 96 may easily push the partially formed package 12 from the indexing turret wheel 88, as will be subsequently discussed. Additionally, such protrusion 218 functions to avoid a corner lap, i.e., where the opposing foil sides do not join each other on the mandrel corner 219. Such avoidance of the corner lap provides for a smoother foldable fin and a package 12 with a better appearance and improved tightness of fit.

With reference to FIG. 1, taken in conjunction with FIGS. 2, 6, 12 and 13, the foil fin folder means 108 and the bottom fin forming and sealing means 110 are more clearly illustrated. Both of the above are to be simultaneously operated at the third operating position when the previously mentioned foil folding and side sealing operations are to be performed at the second operating position. Such simultaneous operation results from the fact that the first oscillating drive shaft 120 of the folding and sealing drive means 102 operates conjointly with the second oscillating drive shaft 122 which, as noted, provides the drive for both the foil folder means 104 and bottom fin forming and sealing means 110. It is to be understood, of course, that at the completion of the steps at the second operating position, the index turret wheel 88 is appropriately advanced to the third operating position while a mandrel 90 from the first operating position is correspondingly advanced to the second operation position for operations to be performed by the foil folder means 104 and side fin sealing means 106.

Figure 6:
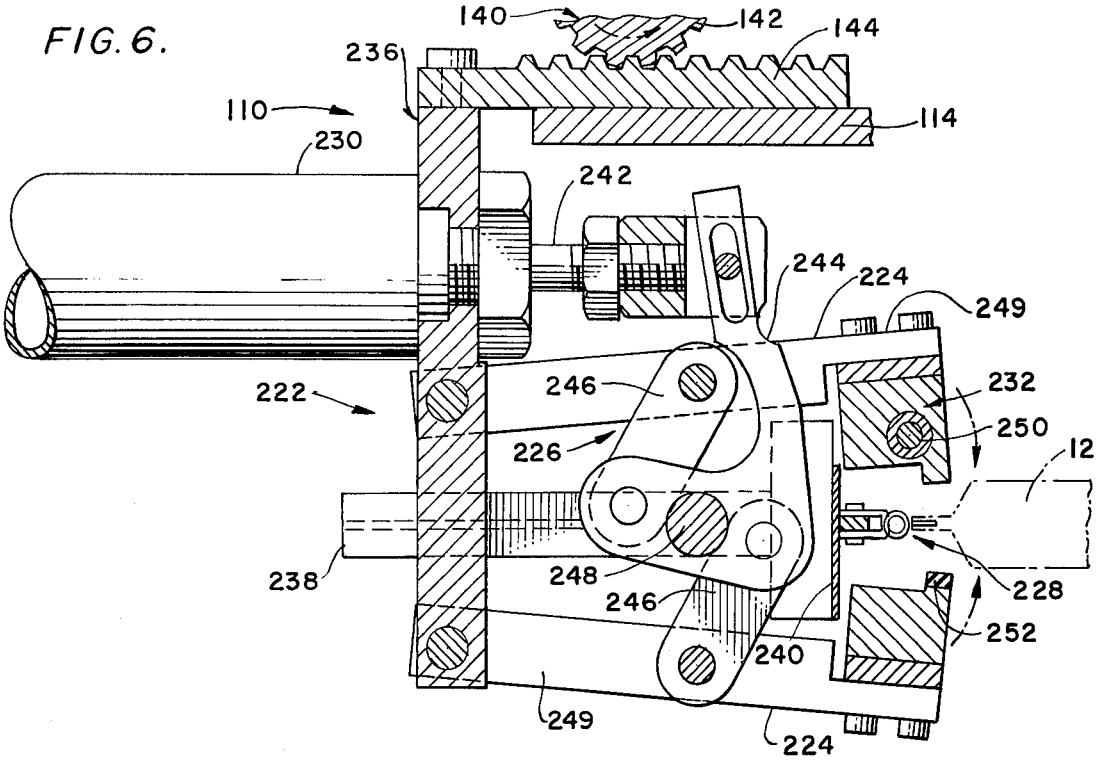
FIG. 6 is a sectional side elevational view substantially taken along the section line 6—6 in FIG. 2 and illustrating the bottom sealing assembly of the present invention.
Figure 13:
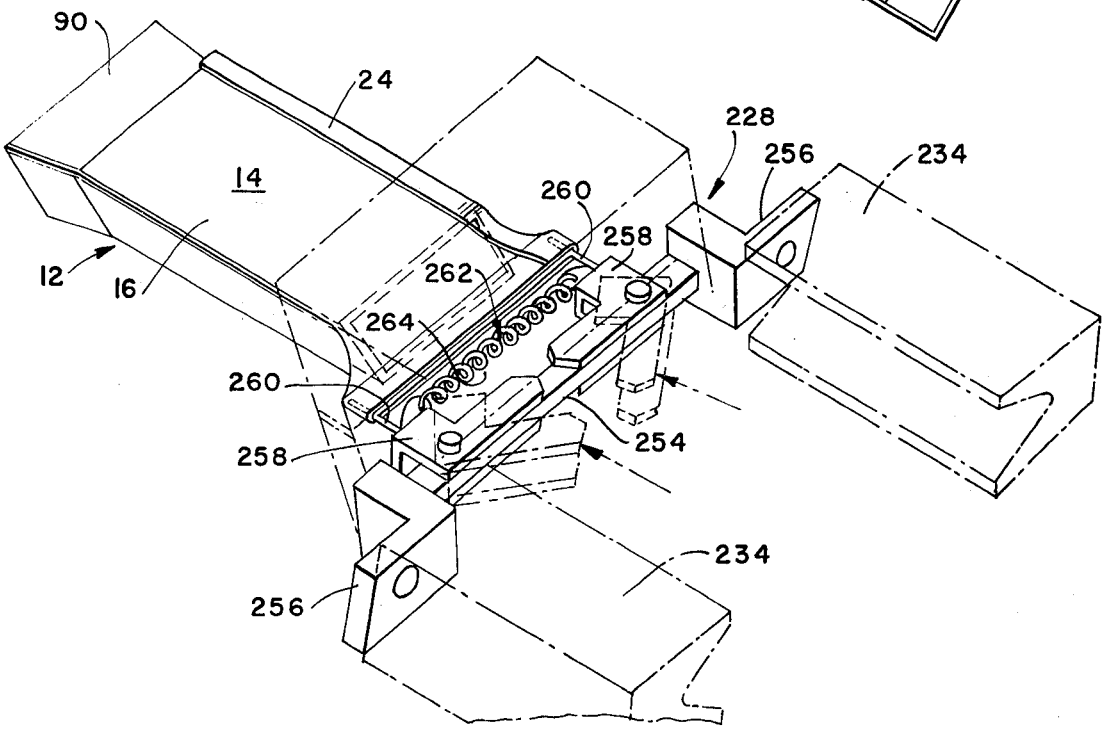
FIG. 13 is a perspective view of the bottom spreader pins made in accordance with the principles of the present invention illustrating their cooperation with the wrapping foil.
Figure 14:
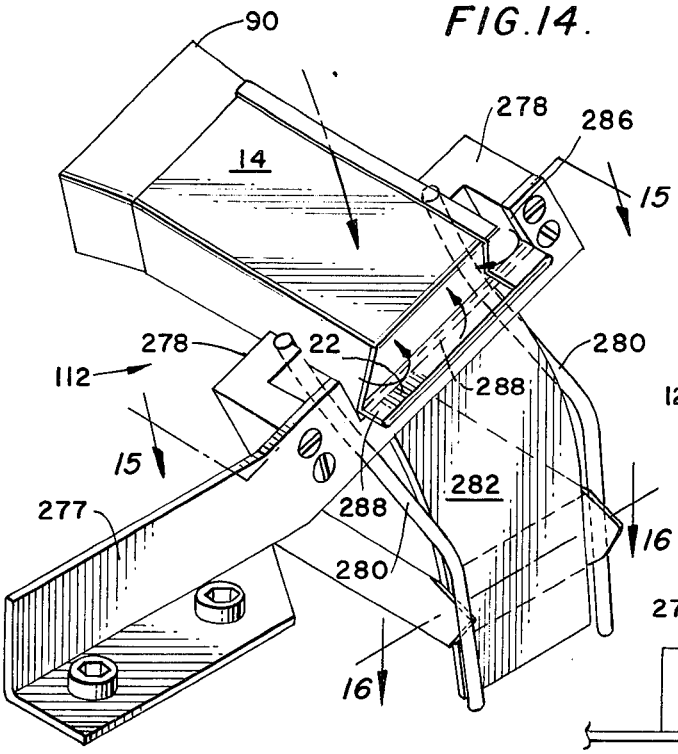
FIG. 14 is a perspective view of the bottom fin folding assembly.
Figure 15:
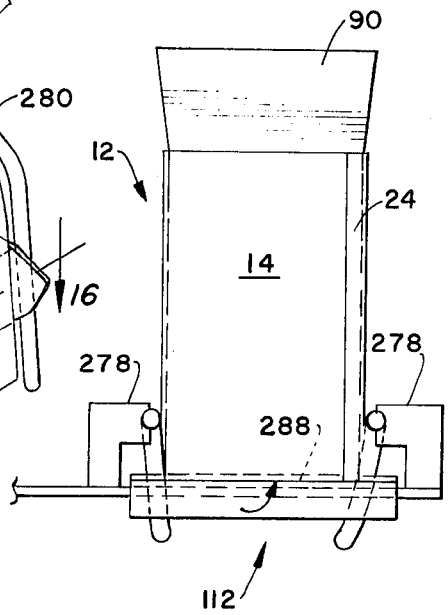
FIG. 15 is a plan view taken substantially along the line 15—15 in FIG. 14 looking in the direction of the arrows and illustrating another view of the bottom fin folding assembly.
Figure 17:
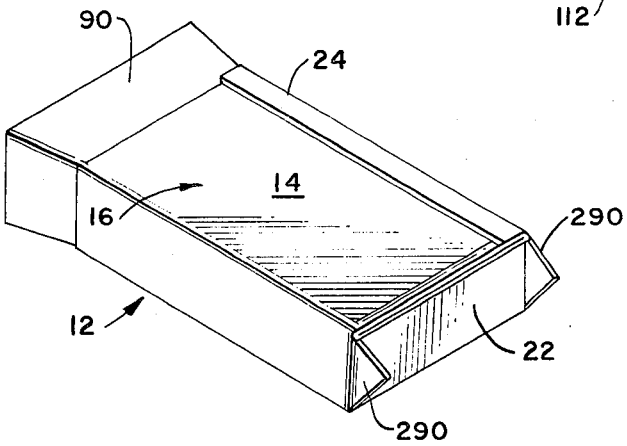
FIG. 17 is a perspective view illustrating the partially formed package with the bottom ears extending generally longitudinally to the major axis of the package.
Figure 16:
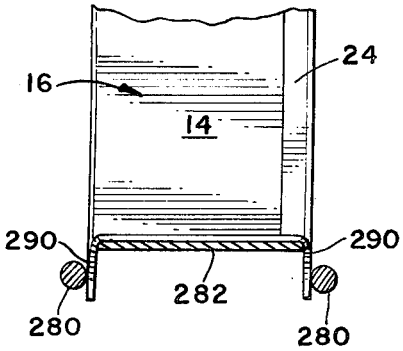
FIG. 16 is a view taken substantially along section line 16—16 in FIG. 14 and illustrating the manner by which the bottom ears are folded.

Specifically referring to FIGS. 2, 6 and 13, it is shown that the bottom fin forming and sealing means 110 is operatively connected to the foil folder and seal drive means 102. Briefly stated, in the preferred embodiment of the present invention, the bottom fin forming and sealing means 110 comprises track means 220, bottom fin carriage means 222, a pair of pivotal clamps or jaws 224, second linkage means 226, bottom spreader means 228, second fluid motor means 230 and second heater means 232.

The track means 220 includes two separated and generally V-shaped grooved members 234 which are respectively and suitably secured to the mounting bracket plate 114 and machine framework 32. With reference to FIG. 6, the rack member 144 of the rack and pinion device 140 is suitably connected as by bolts to bottom fin carriage means 222 which carriage means may include a bottom fin support housing generally indicated by reference number 236. Also appropriately connected to the support housing 236 by any suitable fastening arrangement is a pair of generally wedge-shaped guide members 238. Each of the guide members 238 is adapted to slidably cooperate with respective ones of the grooved members 234 for permitting the bottom fin carriage means 222 to reciprocate with respect to the track means 220. By such an arrangement, any oscillation of the second oscillating drive shaft 122 will, through the rack and pinion device 140, cause the rack member 144 and support housing 236 to reciprocate. Reciprocation of the support housing 236 is between an inoperative non-sealing position and an operative sealing position.

Connected to the support housing 236 in any known manner is an actuating plate 240 which is arranged to contact the bottom spreader means 228 in a manner to be presently described. The second fluid means 230 may be of a conventional type. Such second fluid motor means 230 includes a piston rod 242 connected to the second linkage means 226. The second linkage means 226 comprises a pivotal actuating lever, which lever has appropriately connected thereto a pair of rocker arms 246, 246. The actuating lever 244 is pivoted about a pivot shaft 248 which is connected to the support housing 236. Individual rocker arms 246 serve to connect the actuating lever 244 to a pair of pivotal clamps 249 which are, in turn, connected to the support housing 236. As can be readily appreciated, such a linkage arrangement is structurally and functionally similar to the pivotal actuating rod 182 and first parallelogram type linkage 178 associated with the side sealing means 106. Accordingly, appropriate energization of the second fluid motor means 230 causes piston rod 242 to move the actuating lever so as to appropriately operate the rocker arms 246 to move the pivotal clamps 249 towards and away from each other in a fashion to be subsequently described. Also as noted in FIG. 6, one of the pivotal clamps 249 has connected thereto the second heater means 232 which may be defined by a second heater cartridge 250 similar to the above noted type for sealing the bottom fin. The opposed clamp 249 has connected thereto a resilient rubber-like pad material 252 which cooperates in a fashion with the wrapping material 14 during heat sealing operation for the bottom fin as did the silicon rubber friction pad means 184.

With reference to FIGS. 6 and 13 the bottom spreader means 228, is seen to include an elongated bar 254 connected to the grooved members 234 by brackets 256, a pair of pivotal spreader members 258 having spreader pins 260 are pivotally connected to the elongated bar 254, and spreader biasing means 262 which may be defined by a suitable return spring 264. The elongated bar 254 is connected at opposite ends to the track means 220 at the third operating position which is located adjacent the mandrel carrying the partially formed package 12. As indicated by the phantom lines, the spreader members 258 are arranged to be directed inwardly toward the actuating plate. In this manner whenever such actuating plate 240 is moved in the direction of the arrows, the spreader members 258 are moved to their full line position. Accordingly, the spreader pins 260 swing outwardly to spread the bottom end of the wrapping material 14 on the mandrel 90 in the manner indicated in FIG. 13. Such spreading action tends to bring the opposed edges of the wrapping material 14 into contact whereby the second heating means 232 connected to one of the clamps 249 may commence a heat sealing of the formed bottom fin as shown in FIG. 6.

Figure 12:
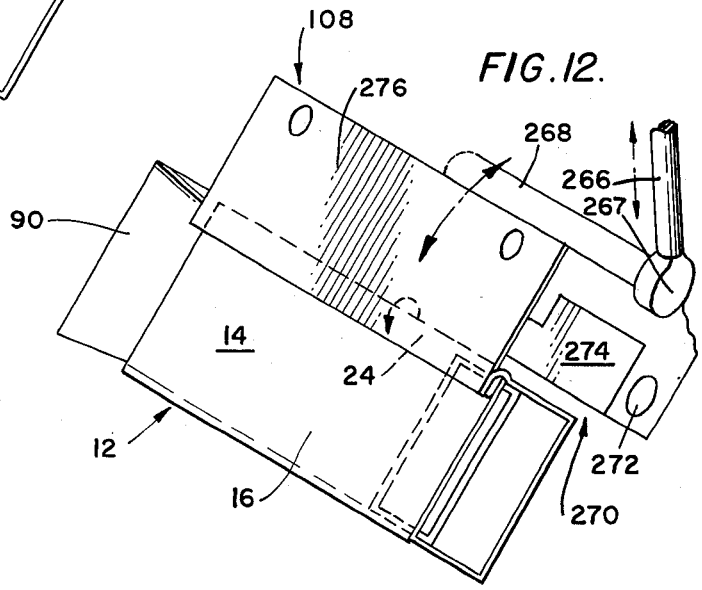
FIG. 12 is a perspective view illustrating the fin folding assembly of the present invention folding the side fin seal.

As more particularly shown in FIGS. 2 and 12, the fin folder means 108 of this embodiment is located at the third operating position and functions to fold the side fin seal 24 onto the package 12. Towards this end, the fin folder means 108, is operatively connected to the drive collar 126 associated with the first oscillating drive shaft 120 by a second connecting rod 266. The connecting rod 266 in turn, is connected at 267 to a rod member 268 or the like which is in turn secured to a fin folder device 270 as by welding or the like. Such fin folder device 270 is pivotally supported by a suitably located hanger shaft 272 extending from the machine base 30. Fin folder device 270 has in the present embodiment an essentially J-shaped body portion 274 and a resilient folder blade 276 connected to a top segment of the body portion 274. The purpose served by the folder blade 276 will be clearly understood with reference to FIG. 12, wherein there is shown the blade 276 folding the side fin seal 24 downwardly and into relatively firm contact with the main portion 16 of the package 12. This action produces a cigarette package 12 with a relatively smooth fin seal 24. To facilitate such a folding action, a resilient type of spring material may be successfully employed for the blade 276. It will, of course, be understood, that the noted pivotal action results whenever the drive collar 126 oscillates thereby causing the connecting rod 266 to vertically reciprocate. Such vertical reciprocation is sufficient to cause the fin folder device 270 to pivot about hanger shaft 272.

As clearly illustrated in FIG. 2 taken along with FIGS. 14 to 17, the bottom fin folding means 112 is depicted situated between the third and fourth operating positions. As perhaps more particularly depicted in FIGS. 14 and 15, the bottom fin folding means 112 includes a stationary folding bracket 277, mounting blocks 278, a pair of folding fingers 280, and a folding guide plate 282. The folding bracket 277 is appropriately secured to the machine framework 32 and has formed adjacent one end thereof a recess 286 which defines a folding edge 288. Such folding edge 288 is located in relatively close proximity to the bottom end of the package 12 as it and the mandrel 90 rotate therepast. Secured to the folding bracket 277 and located below the recess 286 is the folding guide plate 282. Also fastened to the bracket are the pair of mounting blocks 278 which have one end of the folding fingers 280 appropriately connected thereto. These fingers 280 have a somewhat bent configuration, whereby the ends connected to the mounting blocks 278 are on one side of the folding guide plate 282 and the free ends thereof terminate on the opposite side of the guide plate. Also, the fingers 280 bend under the folding bracket 277 and convergingly taper toward the bottom. In addition, such fingers 280 are slightly spaced from the side of the guide plate 282 for purposes afterwards made clear. Thusly, as the bottom fin seal 22 is folded upwardly by the folding edge 288, the bottom ears 290, which result from such folding, make contact with the fingers 280 and are guided and folded thereby, see FIG. 16, as the ears 290 move downwardly between the fingers 280 and folding plate 282. As a consequence thereof, the bottom ears 290 extend in a direction which is generally longitudinal with respect to the package 12. The ears 290 are then folded inwardly in a conventional operation to be performed at a later fifth operating position; for example, the folding operating station generally indicated by reference numeral 291. The particular position of this station has been only generally indicated, since its exact positioning is wellknown in the basic machine.

Figure 20:
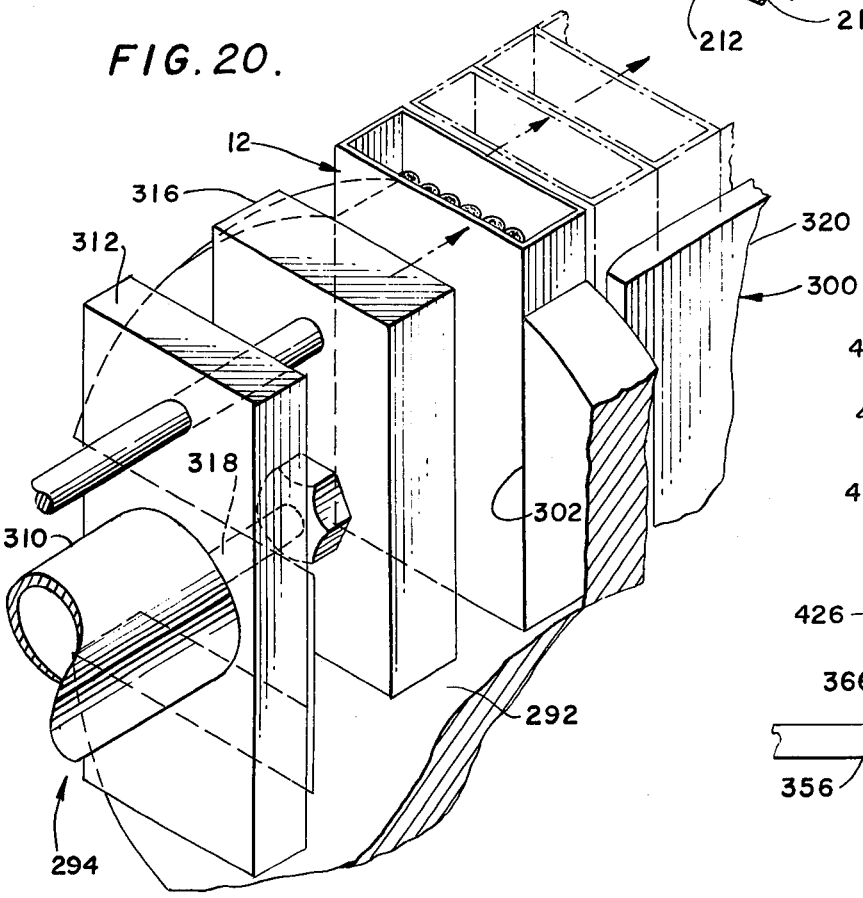
FIG. 20 is an enlarged fragmented perspective view illustrating the cigarette packages being discharged from the indexed transfer wheel to a channel shaped conveying member.
Figure 25:
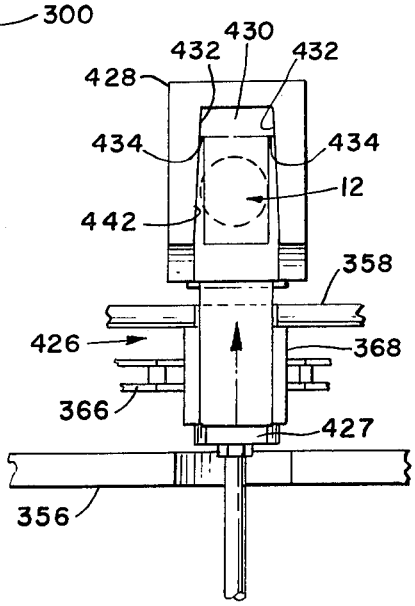
FIG. 25 is a view taken substantially along line 25—25 in FIG. 3 looking in the direction of the arrows and illustrating the second top fin folding and discharge means of the present invention.
Figure 19:
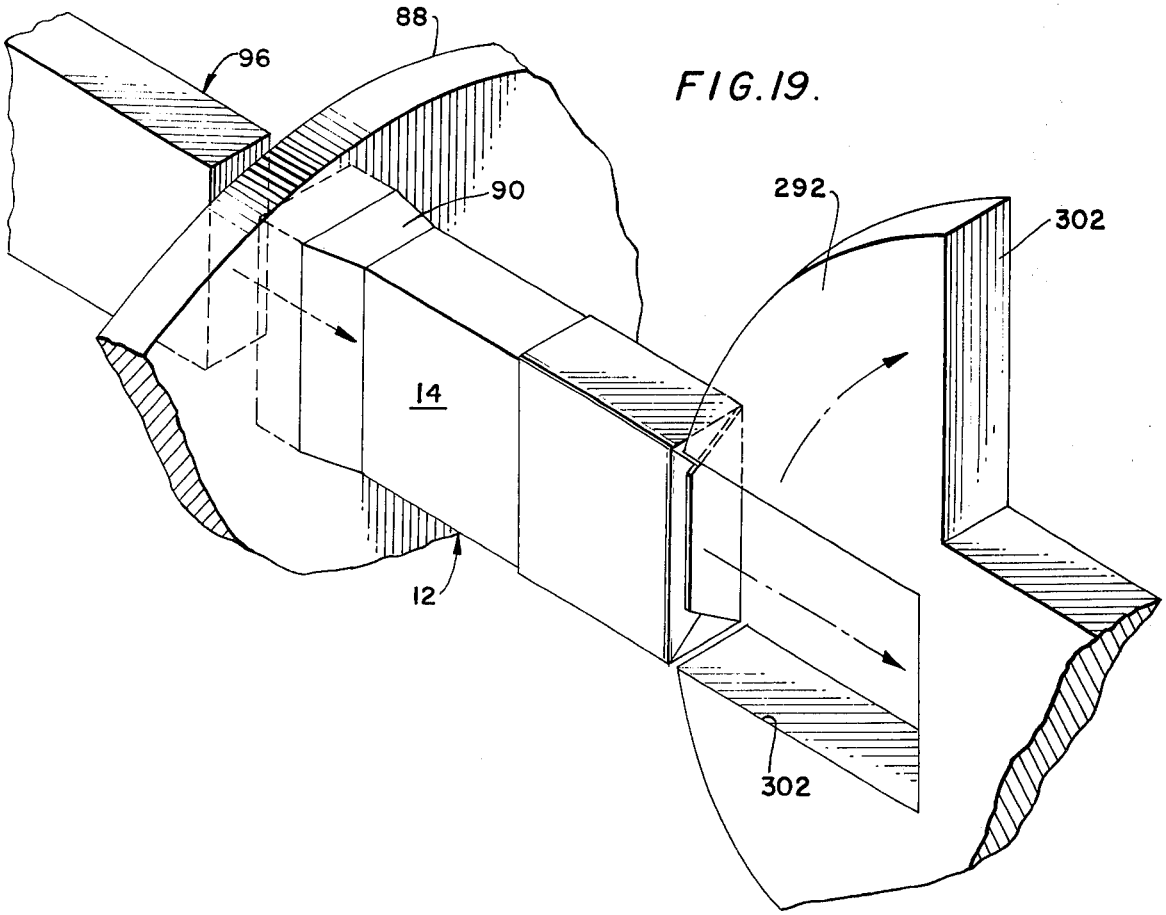
FIG. 19 is an enlarged fragmented perspective view illustrating the partially formed and filled package in the process of being ejected from the mandrel and received by an indexed transfer wheel.

As best depicted in FIG. 1 taken in conjunction with FIGS. 2, 19 and 20, the transfer assembly means 40 is more fully shown. Essentially, the transfer assembly means 40 sequentially transfers individual packages 12 ejected from the indexed turret wheel 88 to the top fin forming and sealing assembly means 42. Such transfer assembly means 40 includes transfer wheel 292, first 294, second 296, and third 298 package pusher means, and conveying means 300.

As more fully shown in FIG. 19, the ejection mechanism 96 is operable to force the forming package 12 containing cigarettes towards the transfer wheel 292. Such action occurs at the first operating position after the turret wheel 88 has completed one revolution.

In this particular embodiment, the transfer wheel 292 has formed therein a plurality of circumferentially spaced and generally radially extending pockets 302. Each of the pockets 302 is sized to receive a single package 12. To consecutively align each of the pockets 302 adjacent the ejection mechanism 96 whenever the latter is operated, a conventional indexing drive unit, indicated generally by reference numeral 304, intermittently drives through a beltdrive 306 the transfer wheel shaft 308 connected to the transfer wheel 292 in known fashion. After the transfer wheel 292 has received a partially formed package, it is rotated through about 90° to a position indicated in FIG. 20. In this position, the first pusher means 294 becomes operable, in a manner to be indicated.

With continued reference to FIGS. 1, 2, and 20, the first package pusher means 294 is seen as including a suitable fluid motor 310 having one end mounted on a bearing block 312 which block, through a vertical support 314, is connected to the machine framework 32. A presser foot 316 is connected to a piston rod 318 associated with the fluid motor 310. It should be readily appreciated that upon energization of the fluid motor 310 the presser foot 316 linearly moves to force a partially formed package from one of the pockets 302 and onto the conveying means 300.

Conveying means 300 is defined by a generally elongated channel member 320 which extends from the transfer wheel 292 to the second and third pusher means 296 and 298, respectively. The packages 12 are transferred from one end of the channel member 320 to the opposite end thereof after a sufficient number of packages have accumulated to the point whereby whenever the presser foot 316 forces one of the packages onto channel member 320 another package down the line is forced to contact and actuate the second package pusher means 296.

Figure 21:
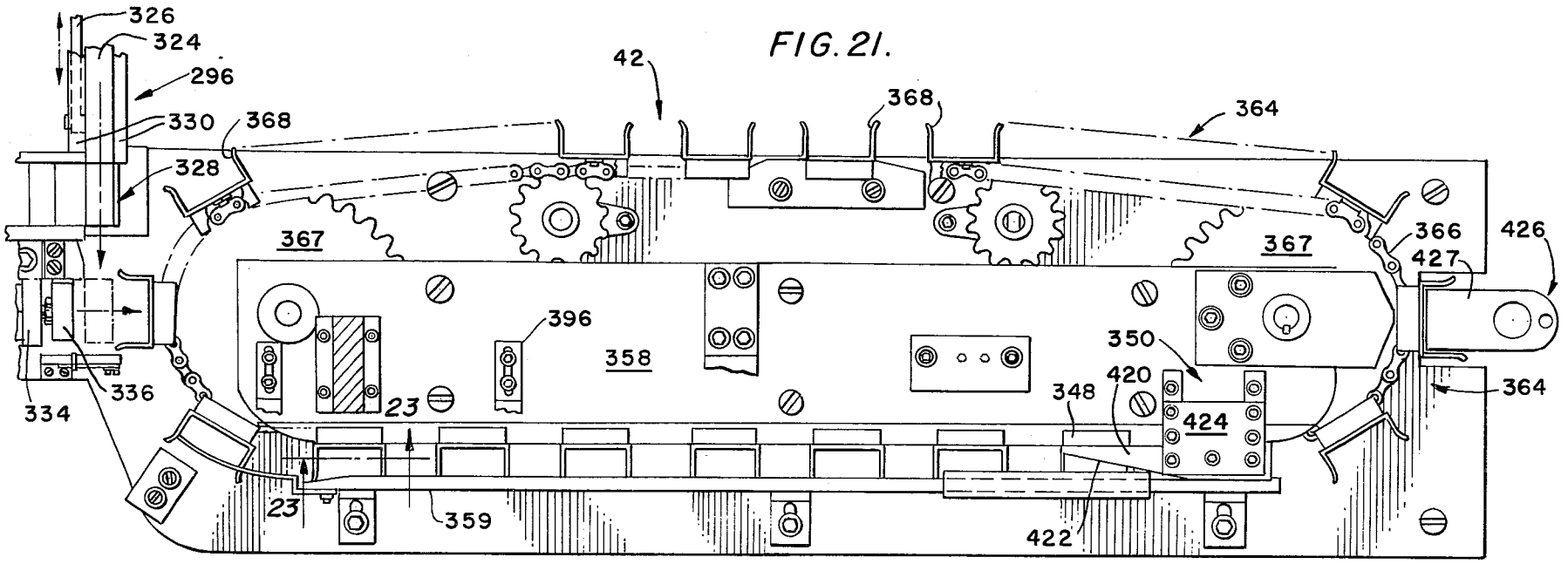
FIG. 21 is a sectional plan view taken substantially along the section line 21—21 in FIG. 3 illustrating in greater detail the indexing table made in accordance with the principles of the present invention.

Now referring to FIG. 1 viewed together with FIG. 21, the second pusher means 296 is seen to include a plunger housing 322, a reciprocating slide plunger 324, plunger drive linkage 326, and a mechanical sensing switch unit 328. The plunger housing 322 may include generally parallel plates 330 appropriately secured together and to the machine framework 32 in any known fashion (not shown). Longitudinally reciprocated in the housing is the slide plunger 324. To effectively reciprocate the plunger 324, the plunger drive linkage 326, which may be of any suitable type to convert oscillating motion to reciprocal motion, interconnects plunger 324 with one of the suitable and convenient oscillating shafts (not shown) but included as a portion of the basic cigarette wrapping machine defined by the above noted patents. The mechanical switch 328 which is provided for may also be of an appropriate type that functions upon contact to release a detent (not shown) which serves to prevent sliding movement of the slide plunger 324. Accordingly, the plunger 324, upon such contact, is free to slide. In such an arrangement as above described, therefore, whenever a package 12 contacts the mechanical switch unit 328, the actuated slide plunger 324 pushes the package from the conveying means 300 and toward the third pusher means 298.

Specifically referring to FIGS. 1, 2 and 21, the third pusher means 298 comprises a suitable fluid motor 332 which is secured to a mounting plate 334 affixed to the machine framework 32. Such fluid motor 332, whenever not actuated, has its presser foot 336 in the general position indicated in FIG. 21. After the second pusher means 296 has been operated in the manner outlined above, the package 12 is transferred to the position indicated in phantom lines in FIG. 21. Thusly, it will be seen that energization of fluid motor 332 is effective to linearly move the presser foot 336 to thereby transfer the package to the top fin forming and sealing assembly means 42.

Figure 3:
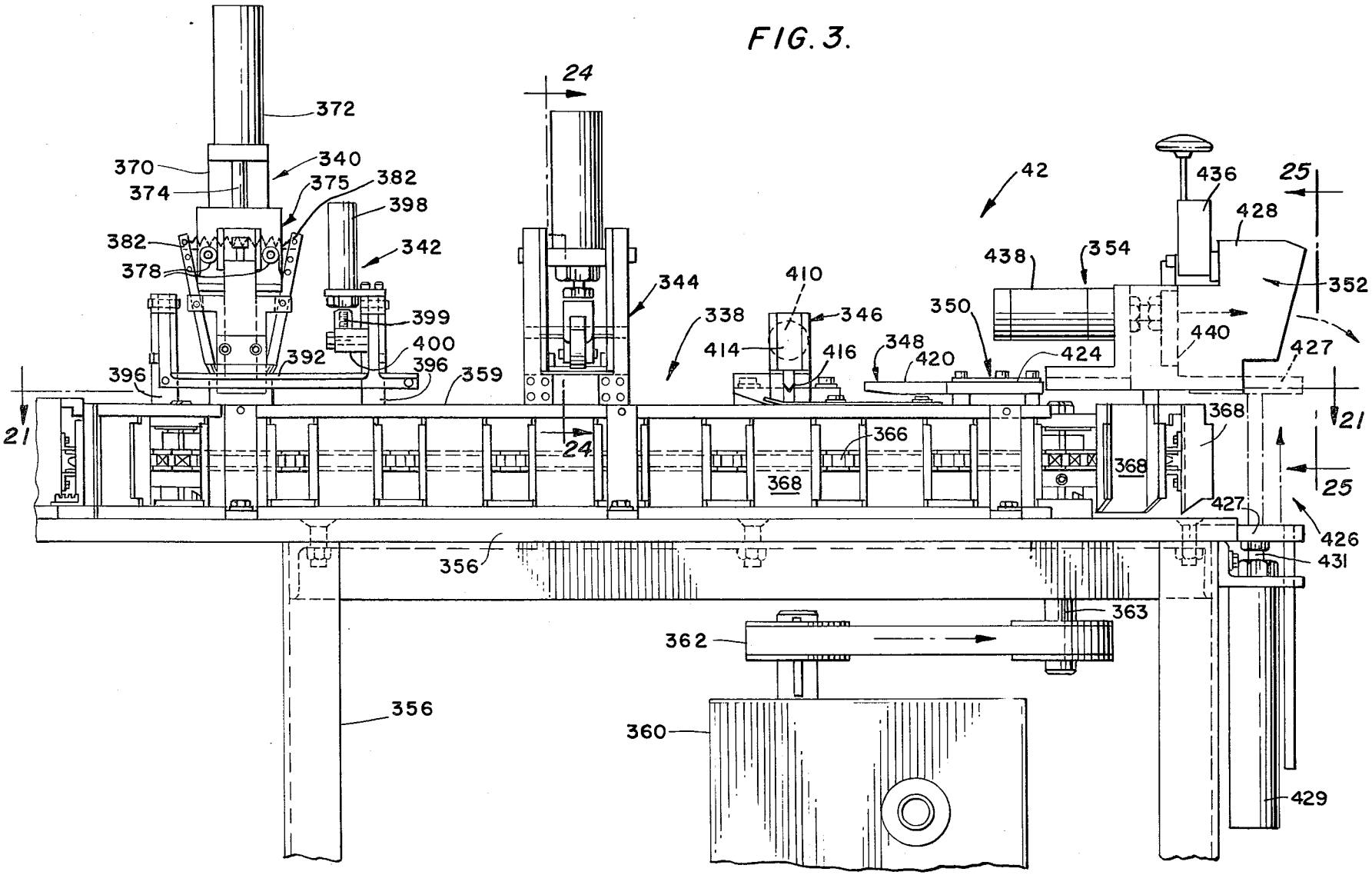
FIG. 3 is a view taken substantially along the section line 3—3 in FIG. 1 looking in the direction of the arrows and illustrating in somewhat greater detail structure of an indexing table used in the automatic wrapping machine.

With particular reference to FIG. 1 taken in combination with FIG. 3, the top fin forming and sealing assembly means 42 is seen to basically include the following components: an incremental advance means 338, top fin spreader means 340, top fin forming means 342, top fin heat sealing means 344, notch means 346, top fin folding means 348, top fin pressing means 350, a second top fin folding means 352, and discharge means 354.

With continued reference to FIGS. 1, 3 and 21, the incremental advance means is more fully disclosed. As shown, a support table 356 is positioned adjacent the discharge end of the third pusher means 298 for purposes afterwards made clear. Suitably mounted on top of the table 356 is an index table bracket plate 358 for the suitable mounting thereon of the several operating components aforementioned and a guide rail generally indicated by reference numeral 359. Also connected to the support table 356, in well-known fashion, is another conventional indexing drive unit 360 which operates similarly to the other heretofore discussed. Such indexing drive unit 360 is appropriately mounted on the table 356 and is connected through a suitable pulley and belt arrangement 362 to drive an input shaft 363 which drives, in well-known fashion, an endless rotary conveyor means 364. The rotary conveyor means 364 of the present embodiment may be of any known type and generally includes a chain linkage 366 driven by sprockets 367. The chain linkage 366 is appropriately moved in response to actuation by the indexing drive unit 360. A plurality of package receiving receptacles 368 are connected to the chain linkage 366. Each receptacle 368 is spaced from each other and is adapted to receive respective ones of the packages 12. The receptacles 368 are generally flat members with upturned and outwardly projecting flanges so as to better accommodate the forming cigarette packages as they are advanced in a manner to be subsequently described. Indexing drive unit 360 is appropriately arranged so as to incrementally advance each of the package receptacles 368 from a loading station to at least respective first, second, third, fourth, fifth, sixth and seventh working stations. The loading station is arranged opposite the third pusher means 298. Accordingly, whenever the third pusher means 298 is actuated to transfer a respective one of the package 12, it will do so in a manner by which the packages 12 will be received by the receptacle 368. Thereafter, package 12 is successively advanced to the first working station.

Figure 23:
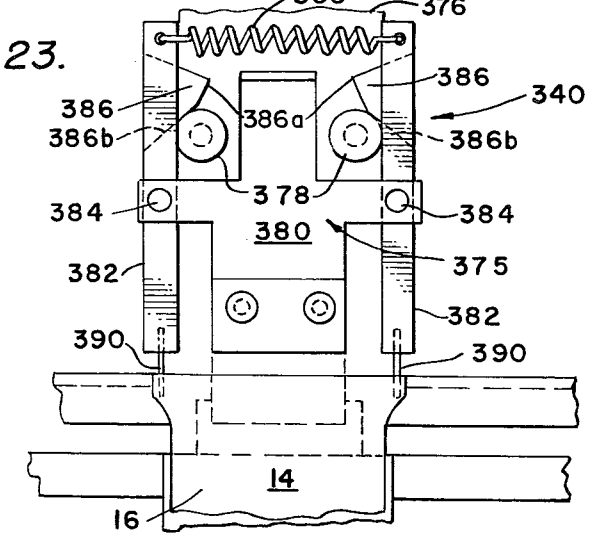
FIG. 23 is a fragmented side elevational view illustrating structure of the top fin spreader device made in accordance with the principles of the present invention.

At this particular station, the top fin spreader means 340 is located for serving to spread the top portions of the wrapping material 14 to thereby facilitate the formation of the top fin seal 20. With reference to FIG. 23, the top fin spreader means 340 is shown in its operative position whereby the wrapping material 14 is spread apart. The top fin spreader means 340 includes a mounting post 370 which is connected to index bracket plate 358. A suitable fluid motor 372 (FIG. 3), such as of the previously noted types, is arranged to extend in a generally vertical direction. A piston rod 374 (FIG. 3) of such fluid motor 372 is connected to a movable means indicated by reference numeral 375. The movable means 375 includes a generally U-shaped mounting block 376 having a pair of cam rollers 378 connected to respective ones of the legs thereof. Additionally, the movable means 375 also includes a spreader carriage member 380. The spreader carriage 380 has two laterally extending projections to which respective ones of generally elongated top fin spreader members 382 are pivoted to such as at 384. Each of the top fin spreader members 382 has connected thereto a cam follower member 386 having a top surface **386*a* and a bottom surface 386*b* for enabling top fin spreader members 382 to pivot inwardly and outwardly. A spreader biasing spring 388 is additionally connected between the top ends of the top fin spreader members 382 so as to bias the top ends of them in a laterally inward direction. Respectively located at the opposite ends of each of top fin spreader members 382 are top fin spreader pins 390 which are so dimensioned for appropriate extension within the top portion of the wrapping material 14 wrapped about the cigarettes. These top fin spreader pins 390 basically function in a manner similar to the spreader pins 260 which are used in the bottom fin spreader means 228. Accordingly, by virtue of the aforenoted construction arrangement, it can be readily appreciated that whenever the fluid motor 372 is appropriately and selectively energized so as to lower the piston rod 374 the cam rollers 378 are moved downwardly from their position indicated in FIG. 3 to that at FIG. 23. Hence, the cam rollers 378 ride onto bottom surface 386*b*. The spreader biasing spring 388 is effective to bring the top ends of the spreader members 382 together. Thusly, the top fin spreader pins 390 will pivot such that they move generally outwardly to the position shown in FIG. 23. In such a manner, the top fin spreader pins 390 will contact and spread the top portions of the wrapping material 14. At the completion of this particular step, the fluid motor 372 is energized to raise the piston rod 374. As can be readily appreciated, cam rollers 378 once again ride onto the cam roller top surface 386*a* to thereby pivot the top fin spreader pins 390 in the opposite direction. Also, pins 309 are raised by rod 374.**

At the completion of the aforedescribed top fin spreading operation, the indexing drive unit 360 is again actuated so as to successively and incrementally advance the receptacles 368 from the first working station to the second working station. At the second working station the top fin forming means 342 is effective to firmly press the opposing sides of the wrapping material 14 together. Thus, such action will further facilitate the subsequent heat sealing operation.

Figure 22:
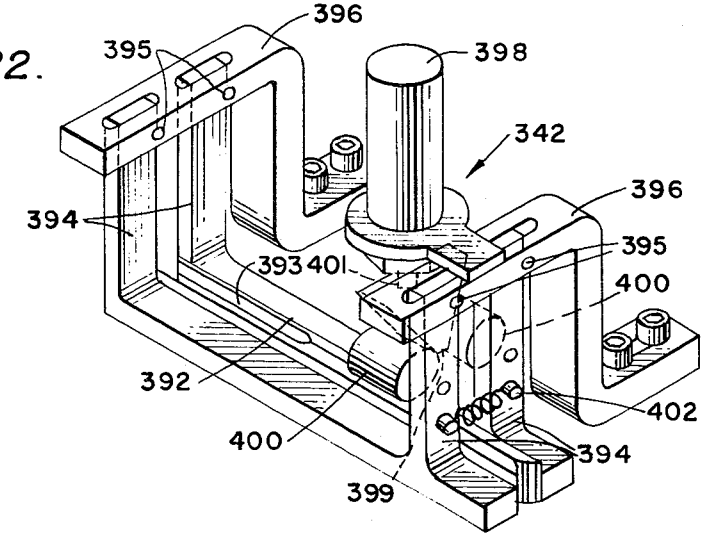
FIG. 22 is a perspective view illustrating a top fin forming device made embodying the principles of the present invention.
Figure 26:
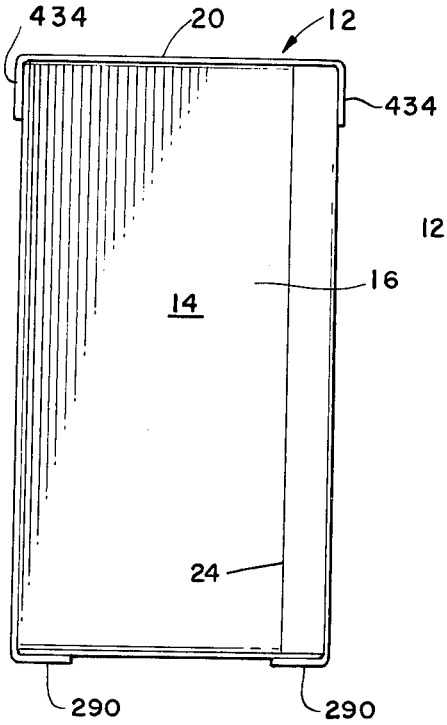
FIG. 26 is a frontal view of a cigarette package made in accordance with the principles of the present invention.
Figure 27:
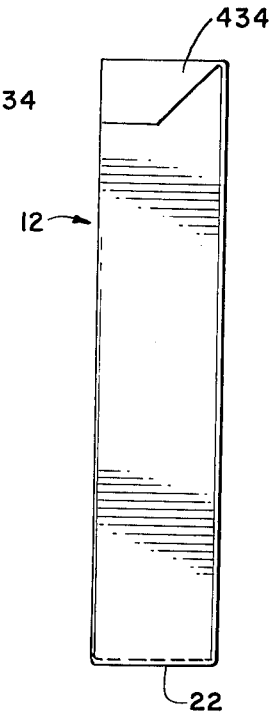
FIG. 27 is an end view of the cigarette package illustrated in FIG. 26.
Figure 28:
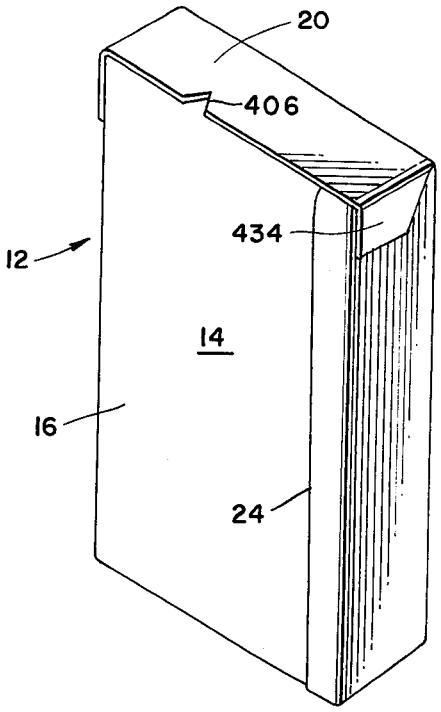
FIG. 28 is a perspective view of the cigarette package illustrated in FIGS. 26 and 27.
Figure 29:
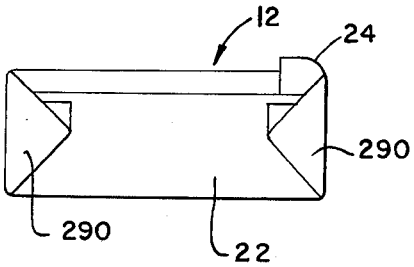
FIG. 29 is a bottom view of the cigarette package illustrated in FIG. 26.
Figure 30:
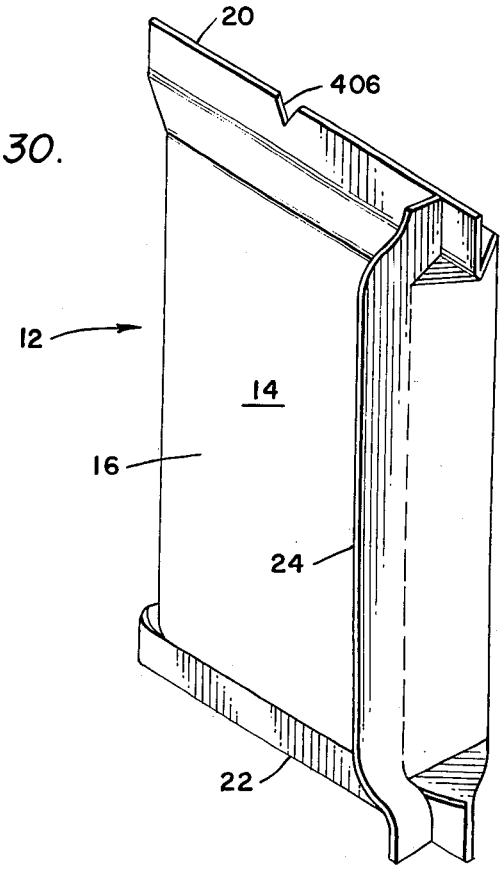
FIG. 30 is a perspective view of the cigarette package but showing in greater details the hermetic-type seals.

Turning now to FIGS. 1, 3 and 22, the top fin forming means 342 may generally include a pair of longitudinally extending forming or pressing bars 392 which are generally parallel to the path the package travels on the table 356. Each of the respective forming bars 392 has upstanding end members 394. Each of the upstanding end members 394 is adapted to be pivotally connected as at 395 to a pair forming bar brackets 396. Brackets 396 are in turn securely affixed to the indexing bracket plate 358. A fluid motor 398 is detachably mounted to one of the forming bar brackets 396. A generally wedge shaped cam member 399 is operatively connected to fluid motor 398 by its rod 401. A pair of generally cylindrical cam followers 400 are respectively suitably secured to respective ones of the members 394. Additionally, a forming bar biasing spring 402 interconnects these end members 394 and normally serves to pivot the generally elongated pressing bars inwardly and together. It should be noted, of course, that the elongated pressing bars 392 are raised from the bracket plate 358 and guide rail 359 by an appropriate distance such that they will normally contact the top portions of the wrapping material 14. Also, the pressing bars 392, as viewed in FIG. 22, are spaced apart along a portion thereof at 393 and then are in intimate contact with each other, beneath the fluid motor 398 located at the third working station. Such intimate contact, of course, serves to firmly press the wrapping material 14 to form the top fin. It will be understood that whenever the cam member 399 contacts cam followers 400 the resulting camming action will be sufficient to overcome the biasing of the forming bar biasing spring 402 and pivot the pressing bars 392 apart.

By virtue of the above noted constructional arrangement, whenever the incremental advancement means 338 successively moves a respective one of the packages 12 from the first working station to the second working station the fluid motor 398 thereat is appropriately energized to move wedge shaped cam 399 upwardly to a position as shown in FIG. 22. In so doing, the forming bar biasing spring 402 will be effective to urge pressing bars 392 together. In this manner, they can tightly press the top portion of the wrapping material 14 into a fin. At the conclusion of the top fin forming operation, the fluid motor 398 is again actuated to pivot the pressing bars 392 outwardly. To effect such operation, the wedge shaped cam 399 is moved downwardly to contact the cam followers 400. Accordingly, the pressing bars 392 are pivoted apart. It will, of course, be understood that the biasing force exerted by the forming bar biasing spring 402 will be overcome in this operation.

Figure 24:
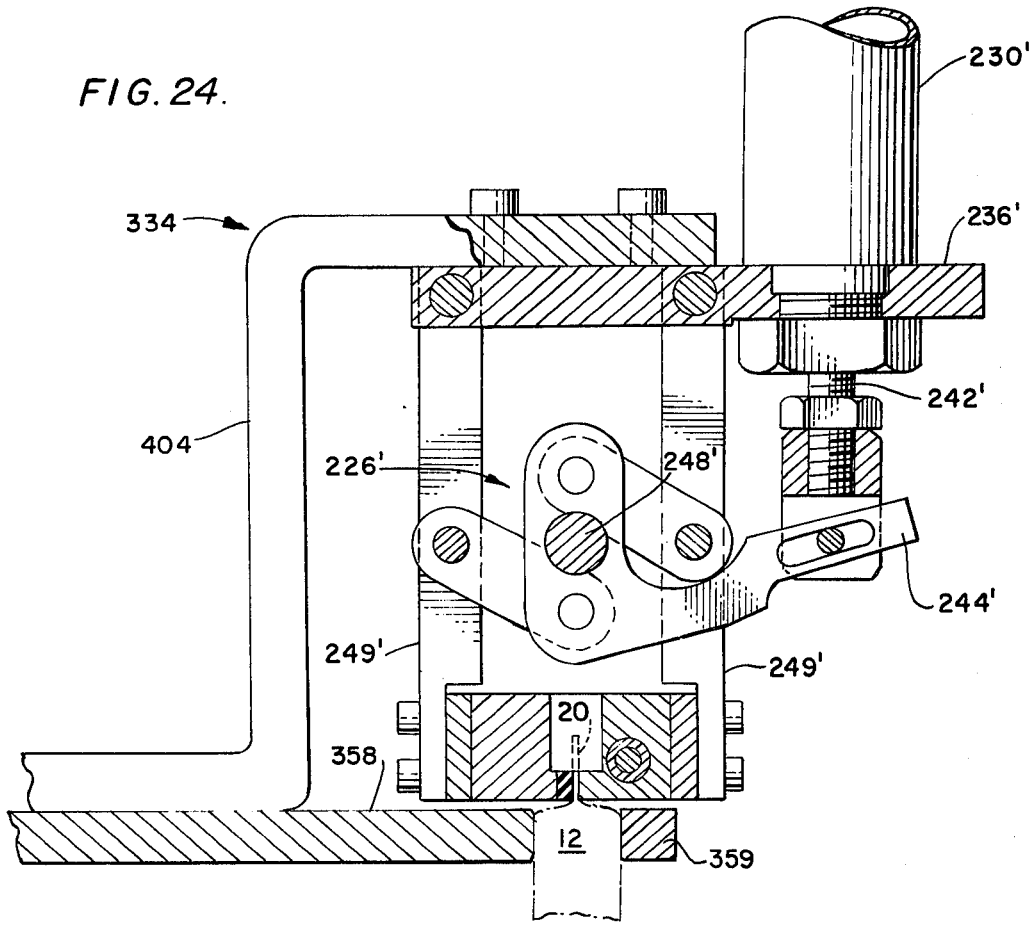
FIG. 24 is a sectional view taken substantially along the section line 24—24 in FIG. 3 looking in the direction of the arrows and illustrating the top fin sealing assembly.

Thereafter, the cigarette package 12 is successively and incrementally advanced to the top fin sealing means 344. The constructional arrangement and operational features of the top fin heat sealing means 344 is essentially similar to that for the bottom fin sealing means 110. Consequently, a discussion of its construction and operation which is similar to that aforediscussed with respect to the bottom fin sealing means has been omitted. To facilitate in the understanding of the top fin sealing means, reference is made to FIG. 24, wherein like reference numerals indicating like structure have been used with the addition, however, of a prime marking. One important difference should be noted and this is the provision of a mounting clamp 404. Such mounting clamp 404 fixedly secures the support housing 236' to the index bracket plate 358. Hence, the top fin will be suitably heated to form the heat seal whenever fluid motor 230' operates linkage means 226' to urge clamps 249' together to thereby heat seal the top fin seal 20.

After the above operation the package 12 is successively and incrementally advanced to the fourth working station. At this particular working station there is shown a conventional type of notch means 346 used to notch material. Such notch means 346 is used to form a notch 406 in the top fin seal 20 (see FIG. 30). Such notch 406 on package 12 normally serves to facilitate a tearing of the formed package so as to gain easy access to the contents.

With reference to FIGS. 1 and 3, such a conventional notch forming means may include a support device 408 connected to bracket plate 358 in a well-known manner. A conventional fluid motor 410 is suitably attached at one end to the support device 408. Appropriately connected by rods 412, only one of which is shown, to the fluid motor 410 for conjoint movement therewith, is a notcher block 414. Such rods 412 are slidably reciprocated within the support device 408. A notching element 416 carried by notcher block 414 is operable upon actuation of the fluid motor 410 to reciprocate the notcher element 416 inwardly towards top fin seal 20. In such a manner the notch 406 is formed. As also more clearly shown in FIG. 1, a suitable vacuum device, indicted generally by reference numeral 418, may be connected to the bracket plate 358 so as to suitably withdraw the notched chips of wrapping material 14. At the conclusion of this particular notching operation, the package is then successively and incrementally advanced along to the fifth working station.

At the fifth working station, the top fin folding means 348 may be defined by a generally triangularly shaped member 420 which is disposed within the path of package travel. The purpose of such triangular configuration is to have the top fin contact the edge 422 (FIG. 21) to thereby gradually fold the notched top fin seal 20 downwardly onto the package 12. Thus, there is an avoidance of abrupt and sudden bending of the wrapping material 14.

From the fifth working station, the rotary conveyor means 364 successively advances the package 12 to the sixth working station. At this particular station, the top presser means 350 of the present invention is effective to more firmly press the folded top fin seal 20 onto the package 12. In th preferred embodiment of the present invention, top fin pressing means 350 may be defined by a generally flat plate 424. The plate 424 is vertically arranged relative to the bracket table 358 and passing packages 12 so that it more firmly presses the folded top fin onto such packages.

Thereafter, the package 12, with the top fin formed in the manner indicated above, is folded and pressed and then successively and incrementally advanced to the seventh working station. At this station, the second top fin folding means 352 is effective to complete the folding operation on the top fin. Basically the second top fin folding means 352 includes an elevator means 426 which is appropriately actuated whenever the package receptacle 368 is stopped at the seventh working station. The elevator means 426 may include a fluid motor 429 having rod 431 which upon energization is effective to raise platform 427 and thereby package 12 from the receptacle 368 and into a discharge housing 428. Discharge housing 428 has suitably formed therein a channel 430 having gradually tapering side surfaces 432 which are effective to downwardly turn the top fin ears 434 onto the sides of the package 12. Consequently, at the conclusion of the second folding operation, the top fin seal 20 has been suitably formed, sealed and folded. To further enhance such a fold, the top fin seal 20 is subjected to a heating operation. Such heat is effective to enable the folded and pressed top fin seal 20 to better retain its folded configuration. Towards this end, a heating block 436 is appropriately arranged adjacent the top of the discharge housing 428 and is elevated to a suitable temperature. Subsequently, the discharge means 354, which may include a fluid motor 438 having connected thereto a pusher block 440, is appropriately actuated. Whenever so actuated, the pusher block 440 pushes the package through an opening 442 formed in the discharge housing 428. After this last step, package 12 has assumed the general configuration shown in FIGS. 26 to 29. It will be understood that the package may be subsequently worked on in conventional fashion.

It is to be understood, of course, that the sequence of operations for the above-noted fluid motors used in the present invention may be controlled in a well-known manner, as for example, by a conventional type timing control device indicated by reference numeral 444.

The operation of the machine and the process of the instant invention are evident from the foregoing description.

However, to supplement such description the process comprises the initial step of advancing a sheet of wrapping material 14 to a first operating position located adjacent and above indexing turret means 34. At this first operating station, the clamp plate 100 of clamping plate 92 clamps a portion of the sheet to mandrel 90 so that the inner surface 18 of the sheet is in contact therewith. After clamping has been accomplished, the foil cutting means 50 is effective to cut the wrapping material into a predetermined length.

When the wrapping material 14 has been clamped and cut, the mandrel is advanced to a second operating position. During transit from the first to the second operating positions, the foil folder means 104 folds an opposite portion of the wrapping material 14 about the mandrel 90 such that the inner surfaces 18 of opposing side edges of the sheet are moved into close proximity with each other. The side sealing means 106 is actuated so that the jaws 176 contact the formed side fin and heat seal the opposed side edges together. Thusly, at the second position, side fin seal 24 is formed.

Subsequent to the noted heat seal operation, the mandrel 90 is indexed to a third operating position. At this position, the bottom spreader means 228 spreads the bottom end of the package 12 to enable formation of a bottom fin. The second heater means 232 contacts the bottom fin, as shown in FIG. 6, to heat the spread edges of the bottom fin. Hence, a heat sealed bottom fin 22 is formed.

At the conclusion of the above step, the mandrel 90 is advanced to a fourth operating position. During this movement the bottom fin seal 22 is folded upwardly. Thereafter, as the mandrel 90 is advanced from the fourth operating position to a cigarette filling position, the bottom ears 291 of the bottom fin seal 22 are in conventional fashion folded inwardly and onto the bottom of the package.

As shown in FIG. 18, the forming package is filled with cigarettes at the filling position. After completion of a single revolution of the indexed turret wheel 88 back to the first operating position, the filled cigarette package is ejected from the mandrel 90.

Subsequently, the ejected package is advanced by transfer assembly 40 to a first top fin forming station on the top fin forming and sealing assembly 42. At the first top fin forming station, top spreader means 340 spreads the top portions of the wrapping material 14. From the first operating position, the rotary conveyor means 364 advances the package 12 to a second top fin forming station whereat the pressing bars 392 tightly press the top portions of the spread wrapping material together so that the inner surfaces 18 of the opposed top edges contact and form a top fin. Thereafter, top fin heat sealing means 344 heat seals the top fin to produce a sealed package.

The top fin seal 20 is then successively advanced so that it is folded by top fin folding means 348 and pressed downwardly towards the package 12 by top fin pressing means 350. In addition, top fin ears are also folded by the side surface 432 in discharge housing 428. At the conclusion of the above recited steps, package 12 is discharged for subsequent operations.

While the invention has been described in connection with a preferred embodiment, it is not intended to limit the invention to the particular form set forth; but, on the contrary, it is intended to cover such alternatives, modifications, and equivalents as may be included within the spirit and scope of the invention defined by the appended claims.

What is claimed is:

1. In an automatic wrapping machine adapted for wrapping and sealing a package made from a foil of thin, flexible, and heat-sealable wrapping material in which said machine includes a support means, a rotatable indexing turret means carrying a plurality of discrete forming mandrels which are circumferentially spaced with respect to each other and are successively rotated in an intermittent step-by-step fashion from a first operating position to at least second, third and fourth operating positions, and a clamping means being effective to clamp a portion of the wrapping material to respective ones of the mandrels at said first operating position, the improvement comprising, foil supply and cutting assembly means operatively connected to said support means for advancing a predetermined length of severed wrapping material to said first operating position, foil folding and sealing assembly means operatively connected to the machine and including foil folding means for folding a side edge of the unclamped portion of the wrapping material about said mandrel and toward the opposite side edge of the clamped portion of the wrapping material as said mandrel is advanced from said first operating position to said second operating position, side sealing means for heat sealing the opposed side edges together at said second operating position to thereby form a side fin seal, fin folding means for folding the formed side fin seal at said third operating position, bottom fin forming and sealing means for forming and heat sealing a bottom fin seal at said third operating position, top fin forming and sealing assembly means operatively connected to said machine for forming and sealing a top fin seal on respective ones of the packages, transfer assembly means operatively mechanically connected to said support means and said machine for selectively transferring a partially formed package filled with the article to be packaged from respective ones of said mandrels to said top fin forming and sealing assembly means, said transfer assembly means including an indexing transfer wheel having a plurality of discrete circumferentially spaced radially extending pockets, each of which is adapted to receive respective ones of the partially formed packages whenever ejection means of said indexing turret means is operated and for selectively transferring the ejected partially formed package circumferentially to a deposit position, first and second and third pusher means mechanically operatively connected to said support means, said first pusher means located adjacent said deposit position and being operable for pushing the package from the indexing transfer wheel, conveying means connected adjacent said first pusher means for enabling conveyance of a plurality of the packages which are pushed by said first pusher means along a path, said second pusher means operatively connected to said support means adjacent an end of the path defined by said conveying means and being actuatable for pushing respective ones of the packages from said conveying means, said second pusher means including mechanical switch means operatively connected to said second pusher means and being operable to actuate said second pusher means upon operative contact therewith by respective ones of the packages, said third pusher means connected to said support means and being actuatable for delivering ones of the packages to said top fin forming and sealing assembly.

2. An automatic wrapping machine as set forth in claim 1 in which said top fin forming and sealing assembly means includes a support table, an incremental advance means supported by said support table and having a plurality of package receiving receptacles each of which is spaced from each other and adapted to receive respective ones of the packages from said transfer assembly means, said incremental advance means being operable to incrementally advance each of said receptacles from a loading station to at least respective first, second, third, fourth, fifth, sixth, and seventh working stations.

3. An automatic wrapping machine as set forth in claim 2 in which said top fin forming and sealing assembly means further includes:

top fin spreader means located at first station for spreading the top portion of the wrapping material;

top fin forming means located at said second station for forming effecting engagement of opposed top sides of the wrapping material to thereby form a top fin;

heat sealing means for heat sealing said top fin at said third station for providing a top fin seal;

notch means positioned at said fourth station and being actuatable for forming a notch in said top fin to thereby facilitate a tearing open of the package;

top fin folding means located at said fifth station for folding said top fin seal onto the package;

top fin pressing means located at said sixth station for pressing the folded top portion more firmly onto the package;

second top fin folding means positioned at said seventh station for removing the package from a respective one of said receptacles and for folding top ears of the top fin downwardly and into contact with the package; and, discharge means located at said seventh position for pushing the package having the folded top ears into a chute or the like.

4. An automatic wrapping machine as set forth in claim 3 in which said top fin spreader means includes a mounting post supported by said support table, a top fin fluid motor having a piston rod and being connected to said mounting post, a movable means connected to said piston rod for vertical movement, a pair of top fin spreader means having lower portions and being pivoted to said movable means for spreading of the wrapping material whenever said lower portions are moved away from each other, return spring interconnecting each of said top fin spreader means such that said lower portions move away from each other, first cam means operatively connected between said movable means and said pair of top fin spreader means and being movable to at least one position whereby the bias of said return spring is overcome to thereby urge said lower portions toward each other.

5. An automatic wrapping machine as set forth in claim 3 in which said top fin forming means includes a pair of generally elongated pressing bars operatively connected to an supported by said support table, a resilient spring means for urging said pressing bars together, top fin forming fluid motor having a piston rod and being operatively connected to said support table, cam means operatively interconnected between said pressing bars and said piston rod of said top fin forming fluid motor and being movable to a location whereby said pressing bars are moved together and a second location whereby said resilient spring means urges said pressing bars together.

6. An automatic wrapping machine as set forth in claim 3 in which said top fin folding means is defined by a generally triangular shaped member which is disposed within the path of travel of the package such that said triangular member gradually folds the top fin seal downwardly onto the package so as to avoid abrupt and sudden bending of the wrapping material.

7. An automatic wrapping machine as set forth in claim 6 in which said top fin pressing means is defined by a generally flat plate which is vertically arranged relative to said support table and said incrementally passing packages to firmly press the folded top fin onto each of the packages.

8. An automatic wrapping machine as set forth in claim 3 in which said second top fin folding means includes a discharge housing elevator means having a movable platform adapted to cooperate with a package, energizable motor means connected to said platform which upon energization is effective to raise said movable platform to thereby raise the package within said discharge housing, said discharge housing having a channel with gradually tapering side surfaces which are effective to downwardly turn the top fin ears onto the sides of the package as such platform is vertically raised in response to energization of said motor means.

9. An automatic wrapping machine as set forth in claim 8 in which said discharge housing further includes a heating block arranged adjacent the top of the discharge housing and being effective to heat the folded top fin seal so as to provide for a more effective heat seal and to enable the package to better retain its folded configuration.

10. An automatic wrapping machine as set forth in claim 9 in which said discharge means includes means including a pusher block which is effective to push a package from the top of said discharge housing.

11. A foil folder means for use, in combination, with a package wrapping machine having at least one mandrel for folding material onto the mandrel comprising a connection means operatively connected to said machine for transmitting a driving motion therefrom, a pivotal lever arm mechanically operatively to said machine and said connection means for pivotal movement in response to movement of said connection means, a foil folder unit secured to said pivotal lever for pivotal movement conjointly therewith toward and away from the mandrel whereby whenever said foil folder unit pivotally moves toward the mandrel it folds a portion of wrapping material toward the mandrels, and foil folder unit biassing means interposed between said connection means and said pivotal lever for insuring firm engagement of the wrapping material with said mandrel, and for compensating for misalignment of said mandrels and for preventing said folder unit bouncing from said mandrel.

12. An automatic wrapping machine as set forth in claim 11 in which said foil folder unit includes a pair of generally elongated and parallel folder bars for folding the material about said mandrel, at least one resilient strap interconnecting said folder bars, resilient cushion means connected to one of said folder bars for contacting the wrapping material, and the other of said folder bars being tapered for presenting a generally flat surface to said mandrels.

13. A fin sealing means, in combination with a package wrapping machine, for heat sealing opposed portions of heat sealable material of a package or the like comprisng a support frame, a pair of jaws pivotally connected to said support frame and being selectively movable toward and away from each other, linkage means interconnecting both said jaws and being movable for enabling generally equal movement and application of forces by said jaws and for moving said jaws towards and away from each other, pivotal actuating rod means connected to said linkage means and being operable for effecting movement of said linkage means and said jaws, motor means connected to said pivotal actuating rod means and being energizable for operating said actuating means to thereby correspondingly move said jaws towards each other, at least one motion transmitting link connected to said support for enabling a generally vertical raising and lowering of said jaws, motion transmitting means adapted for being driven by an oscillating drive shaft operatively connected to said machine for moving said motion transmitting link to thereby raise and lower said jaws, resilient means interconnected between said motion transmitting means and said support frame for forcing said side fin sealing means downwardly, and heater means secured to a bottom of one of said jaws for heat sealing the material whenever the material is located between said jaws.

14. A fin sealing means as set forth in claim 13 which further comprises friction pad means connected to the other of said jaws so as a portion thereof protrudes beneath a bottom surface of said one jaw.

15. A forming and sealing means for use in combination with a package wrapping machine having a support for forming and sealing opposed portions of heat sealable material forming a package or the like comprising track means mechanically operatively connected to said support, bottom fin carriage means cooperating with said track means for generally longitudinal movement with respect thereto, said bottom carriage means being actuatable for reciprocal movement between an operative position and an inoperative position in response to actuation, a pair of pivotal clamps pivotally connected to said bottom carriage means, linkage means connected to said clamps for moving said clamps toward and away from each other, bottom spreader means connected to said track means, motor means connected to said bottom carriage means and being actuatable for operating said linkage means for moving said clamps together, said bottom spreader means being actuatable whenever said bottom carriage means is moved to said operative position for spreading the foil material of the package and heater means connected to one of said clamps for heat sealing the spread foil material.

16. A forming and sealing means as set forth in claim 15 in which said bottom spreader means includes an elongated bar connected to said track means, a pair of pivotal spreader members having spreader pins pivotally connected on said elongated bar, spreader member biassing means for biassing said spreader pins inwardly, said bottom carriage means including an actuating plate for contacting said spreader members whenever said bottom carriage means is moved to said operative position to thereby pivot said spreader pins generally outwardly for engaging and spreading the material.

17. In an automatic wrapping machine adapted for wrapping and sealing a package made from a foil of thin, flexible and heat-sealable wrapping material in which said machine includes a support means, a rotatable indexing turret means carrying a plurality of discrete forming mandrels which are circumferentially spaced with respect to each other and are successively rotated in an intermittent step-by-step fashion from a first operating position to at least second, third, and fourth operating positions and a clamping means being effective to clamp a portion of the wrapping material to respective ones of the mandrels at said first operating position, the improvement comprising, foil supply and cutting assembly means operatively connected to said support means for advancing a predetermined length of severed wrapping material to said first operating position, foil finding and sealing assembly means operatively connected to the machine and including foil folding means for folding a side edge of the unclamped portion of the wrapping material about said mandrel and toward the opposite side edge of the clamped portion of the wrapping material as said mandrel is advanced from said first operating position to said second operating position, side sealing means for heat sealing the opposed side edges together at said second operating position to thereby form a side fin seal, fin folding means for folding the formed side fin seal at said third operating position, bottom fin forming and sealing means for forming and heat sealing a bottom fin seal at said third operating position, and top fin forming and sealing assembly means operatively connected to said machine for forming and sealing a top fin seal on respective ones of the packages, said foil folder means includes a connection means operatively connected to said foil folder and sealing drive means for transmitting driving motion therefrom, a pivotal lever arm mechanically operatively connected to said support means and said connection means for pivotal movement in response to movement of said connection means, a foil folder unit secured to said pivotal lever for pivotal movement conjointly therewith toward and away from a respective one of said mandrels whereby whenever said foil folder unit pivotally moves toward a respective one of said mandrels it folds the unclamped portion of the wrapping material toward a respective one of said mandrels, and foil folder unit biasing means interposed between said connection means and said pivotal lever for ensuring firm engagement of the wrapping material with said mandrel, and for compensating for misalignment of said mandrels, and for preventing said folder unit bouncing from said mandrel.

18. An automatic wrapping machine as set forth in claim 17 in which said foil folder unit includes a pair of general elongated and parallel folder bars for folding the material about said mandrel, at least one resilient strap interconnecting said folder bars, resilient cushion means connected to one of said folder bars for contacting the wrapping material, and the other of said folder bars being tapered for presenting a generally flat surface to said mandrels.

19. An automatic wrapping machine as set forth in claim 17 in which said foil folder means includes air assist means for directing pressurized air onto the wrapping material while the material is being folded.

20. In an automatic wrapping machine adapted for wrapping and sealing a package made from a foil of thin, flexible and heat-sealable wrapping material in which said machine includes a support means, a rotatable indexing turret means carrying a plurality of discrete forming mandrels which are circumferentially spaced with respect to each other and are successively rotated in an intermittent step-by-step fashion from a first operating position to at least second, third and fourth operating positions, and a clamping means being effective to clamp a portion of the wrapping material to respective ones of the mandrels at said first operating position, the improvement comprising, foil supply and cutting assembly means operatively connected to said support means for advancing a predetermined length of severed wrapping material to said first operating position, foil folding and sealing assembly means operatively connected to the machine and including foil folding means for folding a side edge of the unclamped portion of the wrapping material about said mandrel and toward the opposite side edge of the clamped portion of the wrapping material as said mandrel is advanced from said first operating position to said second operating position, side sealing means for heat sealing the opposed side edges together at said second operating position to thereby form a side fin seal, fin folding means for folding the formed side fin seal at said third operating position, bottom fin forming and sealing means for forming and heat sealing a bottom fin seal at said third operating position, and top fin forming and sealing assembly means operatively connected to said machine for forming and sealing a top fin seal on respective ones of the packages, said side fin sealing means is operatively connected to said wrapping machine and includes a support frame, a pair of jaws pivotally connected to said support frame and being selectively movable toward and away from each other, linkage means interconnecting both said jaws and being movable for enabling equal movement and application of forces by said jaws and for moving said jaws towards and away from each other, pivotal actuating rod means connected to said linkage means and being operable for effecting movement of said linkage means and said jaws, motor means connected to said pivotal actuating rod means and being energizable for operating said actuating means to thereby correspondingly move said jaws towards each other, at least one motion transmitting link connected to said support for effecting a generally vertical raising and lowering of said jaws, motion transmitting means adapted for being driven by an oscillating drive shaft operatively connected to said machine for moving said motion transmitting link to thereby raise and lower said jaws, resilient means interconnected between said motion transmitting means and said support frame for urging said side fin sealing means downwardly, and heater means secured to a bottom of one of said jaws for heat sealing the wrapping material whenever the wrapping material is located between said jaws.

21. An automatic wrapping machine as set forth in claim 20 in which side fin sealing means further includes friction pad means connected to the other of said jaws so as a portion thereof protrudes beneath a bottom surface of said one jaw for avoiding having the wrapping material being sealed to respective ones of said mandrels and for pulling up on the wrapping material as said jaw means are moved closer together to effectuate a heat seal.

22. In an automatic wrapping machine adapted for wrapping and sealing a package made from a foil of thin, flexible, and heat-sealable wrapping material in which said machine includes a support means, a rotatable indexing turret means carrying a plurality of discrete forming mandrels which are circumferentially spaced with respect to each other and are successively rotated in an intermittent step-by-step fashion from a first operating position to at least second, third and fourth operating positions, and a clamping means being effective to clamp a portion of the wrapping material to respective ones of the mandrels at said first operating position, the improvement comprising, foil supply and cutting assembly means operatively connected to said support means for advancing a predetermined length of severed wrapping material to said first operating position, foil folding and sealing assembly means operatively connected to the machine and including foil folding means for folding a side edge of the unclamped portion of the wrapping material about said mandrel and toward the opposite side edge of the clamped portion of the wrapping material as said mandrel is advanced from said first operating position to said second operating position, side sealing means for heat sealing the opposed side edges together at said second operating position to thereby form a side fin seal, fin folding means for folding the formed side fin seal at said third operating position, bottom fin forming and sealing means for forming and heat sealing a bottom fin seal at said third operating position, and top fin forming and sealing assembly means operatively connected to said machine for forming and sealing a top fin seal on respective ones of the packages, said bottom fin forming and sealing means includes track means operatively connected to said support, bottom fin carriage means cooperating with said track means for generally longitudinal movement with respect thereto, said foil folding and sealing assembly means including seal drive means operatively connected to said bottom carriage means for reciprocally moving said bottom carriage means between an operative position and an inoperative position in response to operation of said drive means, a pair of pivotal clamps pivotally connected to said bottom carriage means, linkage means connected to said clamps for moving said clamps towards and away from each other, bottom spreader means connected to said track means, motor means connected to said bottom carriage means and being actuatable for operating said linkage means for moving said clamps together, said bottom spreader means being actuatable whenever said bottom carriage means is moved to said operative position for spreading the foil material on said mandrel and heater means connected to one of said clamps for heat sealing the foil material.

23. An automatic wrapping machine as set forth in claim 22 in which said bottom spreader means includes an elongated bar connected to said track means, a pair of pivotal spreader members having spreader pins pivotally connected on said elongated bar, spreader member biassing means for biassing said spreader pins inwardly, said bottom spreader means connected to said track means adjacent said third operating position and being actuatable for spreading the wrapping material extending from respective ones of said mandrels thereby forcing the opposed bottom edges of the wrapping material together, said bottom carriage means including an actuating plate for contacting said spreader members whenever said bottom carriage means is moved to said operative position to thereby pivot said spreader pins generally outwardly for engaging and spreading the wrapping material.

24. In an automatic wrapping machine adapted for wrapping and sealing a package made from a foil of thin, flexible, and heat-sealable wrapping material in which said machine includes a support means, a rotatable indexing turret means carrying a plurality of discrete forming mandrels which are circumferentially spaced with respect to each other and are successively rotated in an intermittent step-by-step fashion from a first operating position to at least second, third and fourth operating positions, and a clamping means being effective to clamp a portion of the wrapping material to respective ones of the mandrels at said first operating position, the improvement comprising, foil supply and cutting assembly means operatively connected to said support means for advancing a predetermined length of severed wrapping material to said first operating position, foil folding and sealing assembly means operatively connected to the machine and including foil folding means for folding a side edge of the unclamped portion of the wrapping material about said mandrel and toward the opposite side edge of the clamped portion of the wrapping material as said mandrel is advanced from said first operating position to said second operating position, side sealing means for heat sealing the opposed side edges together at said second operating position to thereby form a side fin seal, fin folding means for folding the formed side fin seal at said third operating position, bottom fin forming and sealing means for forming and heat sealing a bottom fin seal at said third operating position, top fin forming and sealing assembly means operatively connected to said machine for forming and sealing a top fin seal on respective ones of the packages, said foil folding and sealing assembly means including a foil fold and seal drive means operatively mechanically connected to each of said bottom fin-forming and sealing means, said fin folding means, and said foil folder means for conjointly operating said bottom fin forming and sealing means, said fin folding means, and said foil folder means, said foil fold and seal drive means comprising mounting means operatively associated with said machine, oscillatable motion producing means adapted to be operatively mechanically driven by said machine, common transmission drive means operatively connected to said oscillatable motion producing means, first and second oscillatable drive shafts being driven in unison by said common transmission drive means, motion converting means operatively connected to said second shaft and said bottom fin forming and sealing means for converting the oscillation of said second shaft into reciprocal motion of said bottom fin forming and sealing means for enabling the forming and heat sealing of the bottom fin seal, and first and second drive members, each of which is respectively connected to said first and second drive shafts, said first drive member being connected to said fin folding means for moving said fin folding means toward and away from said mandrel for folding the formed side fin seal in response to oscillation of said first drive shaft, said second drive member being connected to said foil folding means for folding said side edge of the unclamped portion in response to oscillation of said second drive shaft.

25. An automatic wrapping machine as set forth in claim 24 in which said common drive means is comprised of a gear train means, said motion producing means being defined by a driving lever connected to said gear train means and being reciprocally movable for driving said gear train means such that said first and second drive shafts oscillate in unison with each other.

26. An automatic wrapping machine as set forth in claim 24 in which said motion converting means is comprised of a rack and pinion, wherein said pinion moves in unison with said oscillating second shaft and said rack is mounted for reciprocal movement on said mounting means.

27. An automatic wrapping machine as set forth in claim 25 in which the reciprocal movement of said driving lever is timed with the movement of said turret means so that the operations performed by said folding and sealing assembly means are performed with respect to the movement of said indexable turret means.

* * * * *